US007727051B2

(12) United States Patent
Martin et al.

(10) Patent No.: US 7,727,051 B2
(45) Date of Patent: Jun. 1, 2010

(54) SERVO STROKING APPARATUS AND SYSTEM

(75) Inventors: Jose L. Martin, St. Louis, MO (US); Russell L. Jacobsmeyer, Labadie, MO (US); Carl A. Mik, St. Louis, MO (US); David M. Moehn, Alton, IL (US); Michael J. Nikrant, Columbia, IL (US)

(73) Assignee: Sunnen Products Company, St. Louis, MO (US)

( * ) Notice: Subject to any disclaimer, the term of this patent is extended or adjusted under 35 U.S.C. 154(b) by 0 days.

(21) Appl. No.: 11/596,839

(22) PCT Filed: Jun. 22, 2005

(86) PCT No.: PCT/US2005/022233

§ 371 (c)(1),
(2), (4) Date: Nov. 17, 2006

(87) PCT Pub. No.: WO2006/002305

PCT Pub. Date: Jan. 5, 2006

(65) Prior Publication Data

US 2008/0032604 A1 Feb. 7, 2008

Related U.S. Application Data

(60) Provisional application No. 60/582,036, filed on Jun. 22, 2004.

(51) Int. Cl.
*B24B 49/00* (2006.01)

(52) U.S. Cl. ..... 451/11; 451/5; 451/57

(58) Field of Classification Search ..... 451/5, 451/8–11, 41, 57, 14, 61, 51, 27, 76, 108, 451/119, 124, 127; 318/567, 569, 571, 568.1; 51/165.93, 165.83, 349
See application file for complete search history.

(56) References Cited

U.S. PATENT DOCUMENTS

| | | | | |
|---|---|---|---|---|
| 755,416 | A | 3/1904 | Tuckfield | |
| 3,126,672 | A | 3/1964 | Calvert et al. | |
| 3,404,490 | A | 10/1968 | Estabrook | |
| 3,664,217 | A | 5/1972 | Schiewek et al. | |
| 3,736,703 | A * | 6/1973 | Estabrook et al. | 451/14 |
| 4,035,959 | A | 7/1977 | Vanderwal, Jr. | |
| 4,143,310 | A | 3/1979 | Fujinawa et al. | |
| 4,189,871 | A | 2/1980 | Rottler et al. | |
| 4,418,305 | A | 11/1983 | Otsuki et al. | |
| 4,423,567 | A | 1/1984 | Raven, III | |
| 4,455,789 | A | 6/1984 | Gehring | |

(Continued)

*Primary Examiner*—Dung Van Nguyen
(74) *Attorney, Agent, or Firm*—Matthews Edwards LLC

(57) ABSTRACT

A servo stroking apparatus and system (10) for honing wherein the cam stroking motion follows a cam profile which produces a finite jerk profile for reducing machine vibration and optimizing one or more honing parameters. The cam profile can be selected for example from a simple harmonic cam profile, a cycloidal profile, a modified trapezoidal profile, apolynomial profile, and a modified sine profile, or a mix of cam profiles. The servo controlled stroker mechanism can include for instance a ball screw mechanism (36), a linear-motor (40), a fluid cylinder, a chain drive or a belt drive. One or more other servo controlled aspects of the honing operation can be synchronized with the servo controlled stroking operation, such as the, rotation of the honing tool.

38 Claims, 23 Drawing Sheets

U.S. PATENT DOCUMENTS 4,534,093 A 8/1985 Jahnke et al.
4,621,455 A 11/1986 Sunnen et al.
4,679,357 A * 7/1987 Richter et al. ..... 451/21
4,816,731 A 3/1989 Boulton et al.
4,887,221 A * 12/1989 Davis et al. ..... 700/181
5,042,202 A * 8/1991 Klein et al. ..... 451/124
5,426,352 A 6/1995 Styfhoorn et al.
5,479,354 A 12/1995 Husslein
6,022,132 A * 2/2000 Schulz ..... 700/186
7,346,973 B2 * 3/2008 Ooe et al. ..... 29/563

* cited by examiner

SERVO VALVE SYSTEM

CHAIN SYSTEM

LINEAR MOTOR SYSTEM

SERVO STROKING APPARATUS AND SYSTEM

This application claims the benefit of U.S. Provisional Application No. 60/582,036, filed Jun. 22, 2004.

TECHNICAL FIELD

This invention relates generally to apparatus, methods and systems for effecting and controlling stroking motion for honing and other applications, and, more particularly, to a servo stroking apparatus and system adapted for optimizing a stoking process and/or profile for a wide variety of applications, particularly for honing.

BACKGROUND OF THE INVENTION

The main problem in the honing process is related to the position feedback and therefore the derivatives of it (velocity, acceleration and jerk). This problem is presently being solved mostly by using dedicated mechanical systems; where the control is done by setting hard limits locking of any adjusting response or simply offering a faulting output as safety response. This is representative of four bar linkage systems. The fast reciprocating motion makes a close loop control historically difficult and expensive.

The present servo stroking apparatus and system concept is related to the feedback information offered by the servo system and the optimization process related to system dynamic output (position, velocity and acceleration) and tool performance. The stroking process in a honing machine is the relative motion between the honing tool and the work piece. The material removal is produced by the contact of the honing tool with the work piece. The present apparatus and system is related to the significant simplification by using current digital control systems and various schemes to transfer rotational to linear mechanical systems (crank mechanism, four bar linkage). This control process is not limited to a ballscrew application as linear motion mechanism. It could be implemented in any system where the control feedback offered the dynamic output information. Examples of other applications for this process are machine tools where reciprocation is obtained by hydraulic cylinders controlled by a servo valve and position controlled by a linear encoder, and a servo motor link to a chain as motion transfer element.

The following lists are a simplified summary of other known honing systems' limitations and problems.

Known Honing Machine Stroking Technology:

1. Stroking output limited by moving mass.
2. Stroking system independent of feed or spindle system (very limited input/output relation to rest of machine).
3. Slow positioning feedback, position error.
4. Relative "geometry correction" depending on measuring last part to make system adjustments in next process part.
5. Slow pre and post process operations.
6. No operational changes depending on tooling or external variables.
7. Unique motion profile.
8. Limited stroke range.
9. Slow and complex dwell system.
10. Relative crosshatch angle.
11. No tool crash protection.
12. No safety control.
13. Complex mechanical system, two independent systems one to position and another one to stroke.

A review of known patents illustrates how the use of electronic/feedback technology is wide spread throughout the machine tool industry. The specifics of the claims of these patents are related to the control and power transmission of this technology to improve or create new processes. The time line of these claims are not related to novel mechanical inventions but to the digital and control improvements produced in systems control and therefore in the machine tool industry. The use of already existent mechanical subsystems and its implementation produced improvements in the final output. Prior art is presented the following example U.S. patents:

| | | | |
|---|---|---|---|
| | | | C. Tuckfield. |
| 755,416 | circa 1904 | "Mechanism for converting reciprocating into rotary motion and vice versa" | National Automatic Tool Company Inc. |
| 3,126,672 | circa 1964 | "Vertical Honing Machine" | Barnes Drill Co. |
| 3,404,490 | circa 1968 | "Honing Machine with automatic force control" | Siemens Aktiengesellschaft |
| 3,664,217 | circa 1972 | "Method and system for digital subdivision of the tool feed travel of a numerically controlled machine tool" | Sunnen Products Company |
| 4,035,959 | circa 1977 | "Cam operated automatic control for a honing machine" | Hitachi Ltd. |
| 4,143,310 | circa 1979 | "Apparatus for positioning" | Rottler Boring Bar Co. |
| 4,189,871 | circa 1980 | "Honing machine" | Hitachi Ltd. |
| 4,418,305 | circa 1983 | "Velocity Feedback Circuit" | Alfred J. Raven III. |
| 4,423,567 | circa 1984 | "Power stroking honing machine and control apparatus" | Maschinenfabrik Gehring GmbH |
| 4,455,789 | circa 1984 | "Self-controlled honing machine" | Textron Inc. |
| 4,534,093 | circa 1985 | "Beo-type Machining System" | Maschinenfabrik Gehring GmbH |
| 4,679,357 | circa 1987 | "Method and apparatus for displacing a honing tool" | Delapana Honing Equipment Limited |
| 4,816,731 | circa 1989 | "Honing Machine" | Caterpillar Inc. |
| 5,426,352 | circa 1995 | "Automatic honing apparatus" | HMR GmbH |
| 5,479,354 | circa 1995 | "Method for the computer-assisted control of a machine or process" | |

Each of the above mentioned patents are representative of improvements in the machine control system. Most illustrative of early systems is U.S. Pat. No. 755,416 C. Tuckfield "Mechanism for converting reciprocating into rotary motion and vice versa", which shows the cycle motion repetition produced by the cam profile. Also, with the same importance are the U.S. Pat. Nos. 4,143,310 and 4,418,305 patents, Hitachi's "Apparatus for positioning" and "Velocity Feedback Circuit"; where the main improvement is related to the feedback position and velocity, offering control and total dynamic system information.

U.S. Pat. No. 4,816,731 "Honing Machine" by Delapena Honing Equipment Limited, clearly represented the use of digital control technology in a honing machine. The same control is representative of the machining process in other equipment where the limitations were established by the control development not by the process. The mentioned patent clearly addresses all the actual honing technology problems except points 7 and 11 above. These two points are limited in their concept. The complete concept is itself limited by the technology utilized being in principle as slow as their control loop. U.S. Pat. Nos. 4,816,731, 4,621,455, 4,455,789, and 4,423,567 each represent a honing machine where there is a relative motion between the honing tool and the work piece. Also, the honing tool is expanding radially at the same time that rotates. The removal of material is therefore produced by the honing tool surfaces being harder that the work part.

In U.S. Pat. No. 4,816,731, column 7, lines 17 to 44, a unique motion profile is described. This motion profile is sectioned in 6 sub cycles: Forward acceleration, forward steady speed, forward deceleration, backward acceleration, backward steady speed, and backward deceleration. This acceleration profile per cycle produces uncertainties in the jerk output. These uncertainties are reflected in the position profile with inconsistency and vibrations throughout the mechanical components. This position error is clearly encountered by the honing machine of U.S. Pat. No. 4,816,731 (column 8, lines 1 to 14). The vibrations problem is also controlled by reducing possible output. This is described in column 6, lines 15 to 22. The problem is underlined on page 25, section 2.5 of "Cam Design and Manufacturing Handbook" by Robert L. Norton. It says "If we wish to minimize the theoretical peak value of the magnitude of the acceleration function for a given problem, the function that would best satisfy this constraint is the square wave . . . ." This function is also called constant acceleration. This function is not continuous. It has discontinuities at the beginning, middle and end of the interval. So by itself, is unacceptable as a cam acceleration function."

A schematic representation of this motion profile is shown in FIG. 1 of the drawings. As represented in FIG. 1, the discontinuities of the acceleration function produce an infinite jerk output that violates the cam design corollary. In cycling motion, J1 and J6 are removed, given that the motion is linking from cycle to cycle. The other four discontinuities make the usage of this motion profile very limited.

Thus, what is sought is an apparatus and system which overcomes many of the problems and shortcomings set forth above.

SUMMARY OF THE INVENTION

The servo stroking system technology of the present invention is intended to overcome many of the problems and shortcomings set forth above by providing one or more of the following advantages and capabilities.

1. The system is designed to maximize output.
2. The motion profile is related to acceleration output not position
3. The stroking system motion decisions are made modular in the system drive, creating a parallel system, saving time processing independently of the number of honing columns.
4. The design optimizations were established as part of every component limitations (max acceleration, max rotational speed, max jerk, safety response).
5. Use of output power to control system performance and best match tool performance.
6. Simplified automation process.
7. The power transmission is not limited to ball screw, could be a chain or a hydraulic cylinder, etc.
8. Synchronization between stroker system and any other servo system in the machine. Increasing substantially accuracy for cross-hatch angle and profile honing (dwelling positioning, cross-hatch angle everywhere in the bore).
9. System optimization independently of tool/workpart relative motion (moving tool/fix workpart, fix tool/moving workpart).

In a preferred aspect of the present invention, the reciprocation of a honing tool is based on a digitalized motion profile representative of one cycle. This profile is optimized to maximize the force applied by the honing tool minimizing the reaction in the structural machine components. This optimization process is not related to the machining process orientation. That is, the same optimization process can be used for a vertical or horizontal process. The main difference will be represented in the addition of the gravity force as input in the vertical case. The optimization is based in the fundamental law of Cam Design. "The jerk function must be finite across the entire interval." This principle has been in use in Sunnen's honing machines for the last 50 years. In those machines, the principal is mainly implemented by a predetermined center offset within a four bar linkage. Therefore, the reciprocation frequency is established by the rotation speed of the offset point; and the reciprocation displacement of the slider is determined by the pivoting point location. This scheme control is very efficient given that the dynamic profiles are optimized by the use of the simple harmonic cam profile. This profile offers a very good output for short displacements.

The motion control of the present invention will be limited by the systems variables to be optimized (cycle time, profile acceleration, tool performance, material removal, system vibrations). In the same way, the control protocol will be modified to most accurately represent system constraints (work part physical characteristics, honing machine and reciprocation characteristics). To improve performance, the honing process will be divided into subsets where every subset could require an optimized process or profile. Examples of this include the following:

To divide work part honing cycle into process steps: roughing and finishing. The roughing process will be concentrated in total material removal and bore shape and finishing will be concentrated in surface finish, hatching angle and final size and bore shape. This control scheme is not new but the implementation will be new by using the motion profile that best matches the application. As an example, in the roughing period, profiles with high radial velocity and controlled high acceleration could be used. In the finishing period, profiles with smooth and minimized acceleration and jerk profiles could be used.

As another example, in vertical applications the acceleration profile could be non symmetrical to ensure that the honing tool and machine components encountered a symmetrical force input in both directions, therefore compensating for the gravity input.

Another example is tandem parts (FIG. 2.) Every one of the bore sections has a different size or finish requirements (hatch angle, size, tolerance . . . ) and with the present invention, the honing process or profile can be optimized for each bore section.

Still another example is multi part honing, wherein every part has different requirements. The present invention can be utilized to improve the total machine output by removing setup time for each work part. Instead, a desired honing profile for a part for achieving desired characteristics is selected.

The servo system stroke of the invention is based on a parametric profile curve; this motion profile curve will be scaled depending on the specific stroke length. The reciprocation is based on a digitalized motion profile representative of one honing cycle. That is, one stroke in a first direction, and a return stroke in the opposite direction. This profile can be optimized to maximize the force applied by the honing tool, minimizing the reaction in the structural machine components. This optimization process is not related to the machining process orientation. The same optimization process will be done for a vertical or horizontal process. The main difference will be represented in the addition of the gravity force as input in the vertical case. The optimization is based on the fundamental law of Cam Design. "The jerk function must be finite across the entire interval."

The present servo system preferably uses a directly coupled system to reduce the number of variables and uncertainties. The motion profile uncertainty is therefore reduced to one joint, a ball nut in the instance wherein the servo is a ball screw. Therefore, the position accuracy is increased substantially.

The motion profile produces a variable position, radial speed and acceleration curve throughout the entire profile. The only necessary limiting factor is set as a safety control for the machine structure integrity. Therefore the process decision is limited to a stroke length, stroke rate and spindle speed to achieve the desired cross-hatch angle and removal rate. The cross-hatch angle can be optimized by synchronizing the spindle motion with the stroker. This relation can be in the same way applying to the tool feed or any other machine servo system. The following schematic represents this interrelation.

The present servo stroker relates the control scheme of the stroker to an independent controller/drive unit, where inputs are related to stroke length, position of stroke, start stroking process and stop stroking process. Therefore the positioning scheme is simplified, thereby reducing operation time. This change increases the reaction time significantly. The motion profile curve is independently verified and controlled from the rest of the machine operation increasing total throughput. This improvement is reflected in system performance by increasing stroke rate output. Two different systems have been tested where the stroker rate (given the mechanical system limitations) got as high as 10 cycles per second for a 25.4 mm stroke. Therefore the refreshing time of the stroker position is 0.2 msec. with a 400 times cycle position check system and 0.09 msec. with a 1024 cycle position check system. The position check table is related to a series of different optimized motion profiles. These profiles are explained in more detail in the following sections. Every one of these profiles are parameterized and related to an absolute position.

DETAILED DESCRIPTION OF PREFERRED EMBODIMENTS OF THE INVENTION

Figure 1:
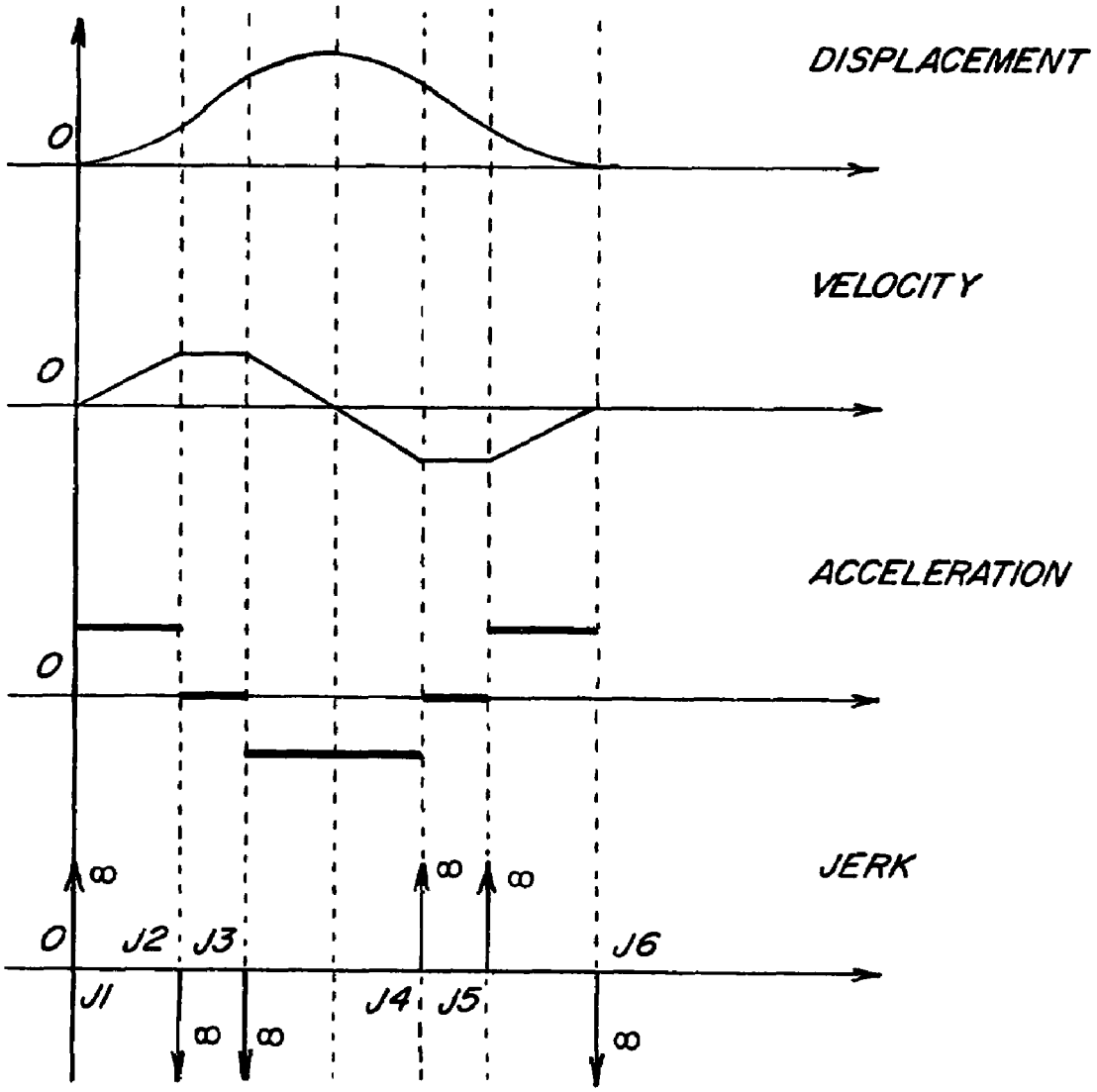
PRIOR ART Fig. 1
FIG. 1 is a graphical representation of displacement, velocity, acceleration, and jerk profiles for a prior art feed control system.
Figure 2:
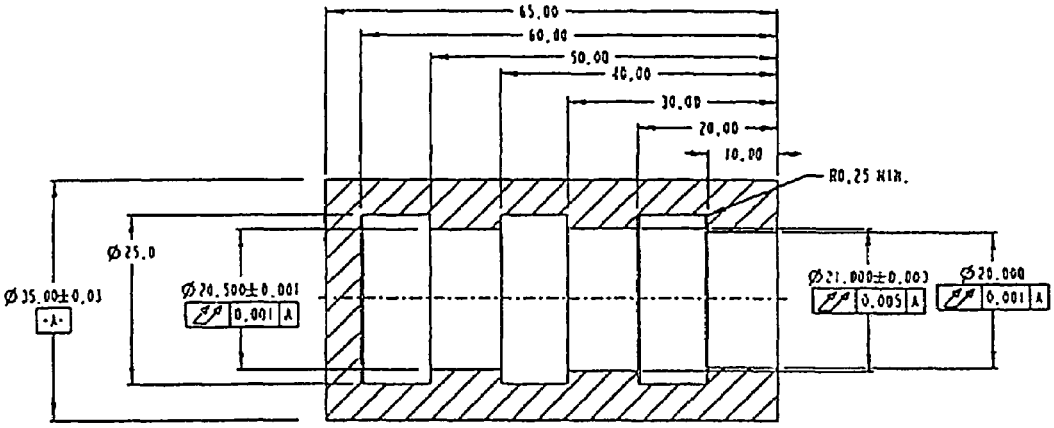
FIG. 2 is a fragmentary sectional representation of a representative work piece having tandem surfaces to be honed.
Figure 3:
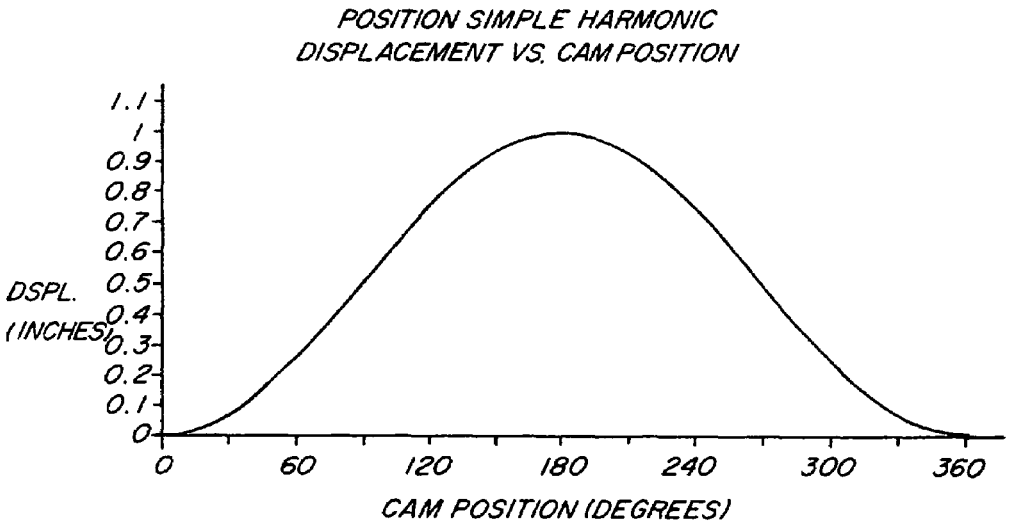
FIG. 3 is a simplified graphical representation of a displacement profile for a simple harmonic cam profile.
Figure 4:
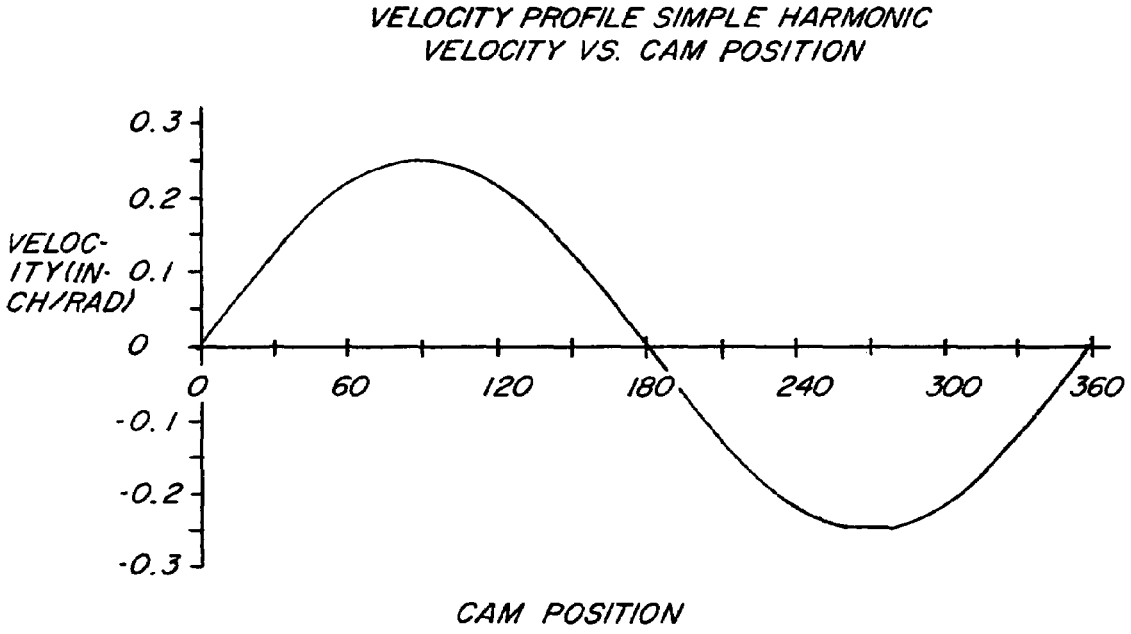
FIG. 4 is a simplified graphical representation of a velocity profile for a simple harmonic cam profile.
Figure 7:
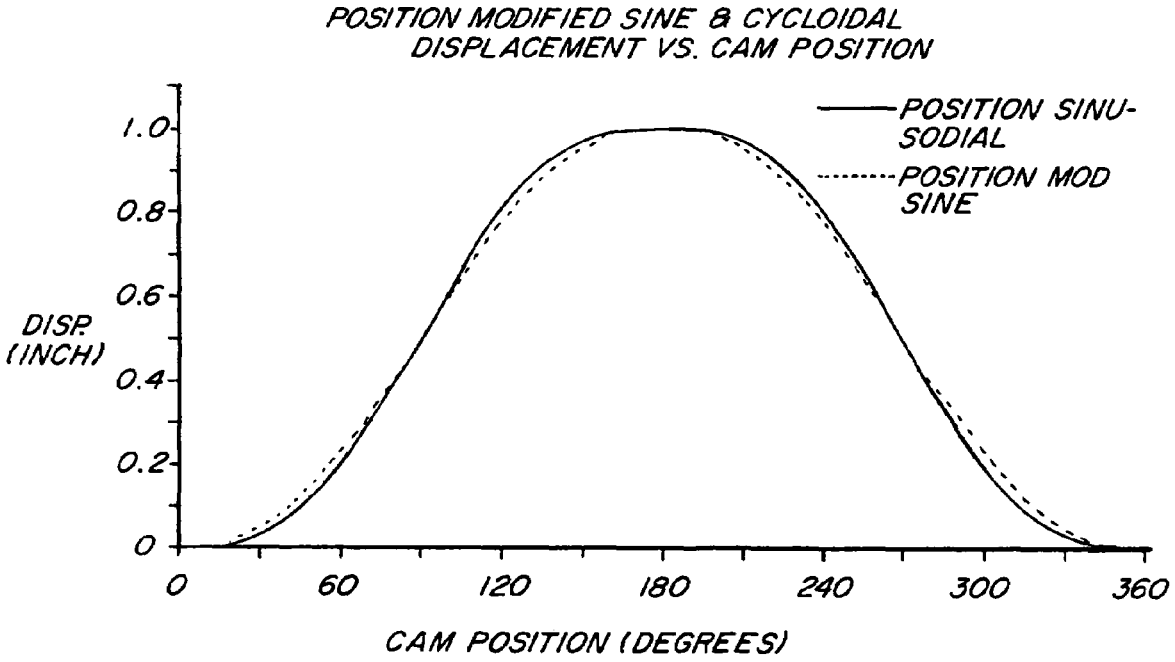
FIG. 7 is a simplified graphical representation of position profiles for modified sine and cycloidal cam profiles.
Figure 5:
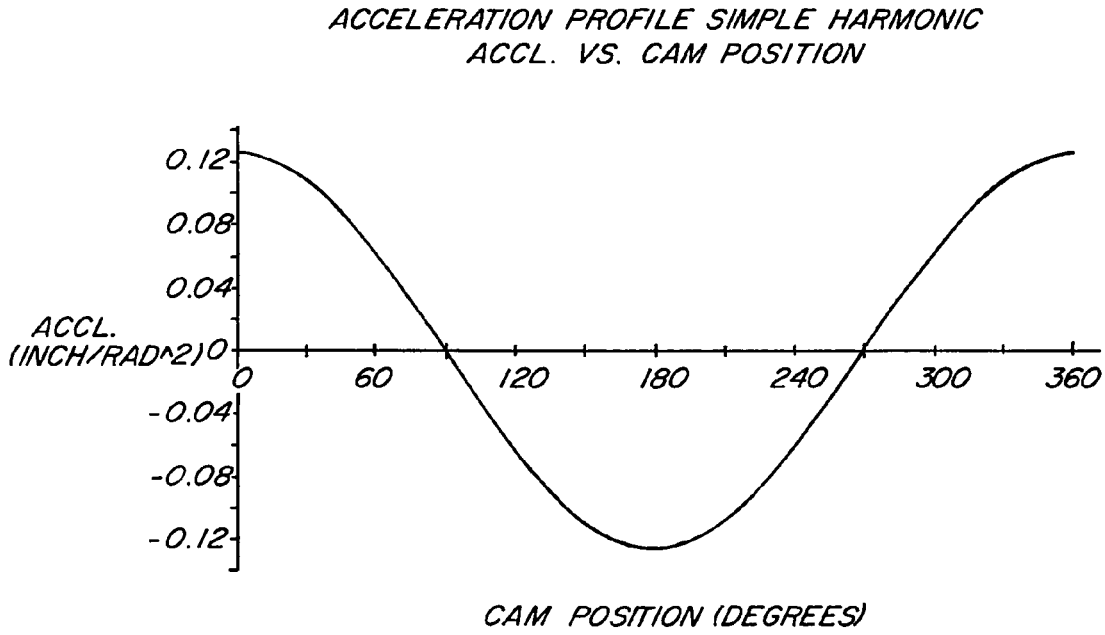
FIG. 5 is a simplified graphical representation of an acceleration profile for a simple harmonic cam profile.
Figure 6:
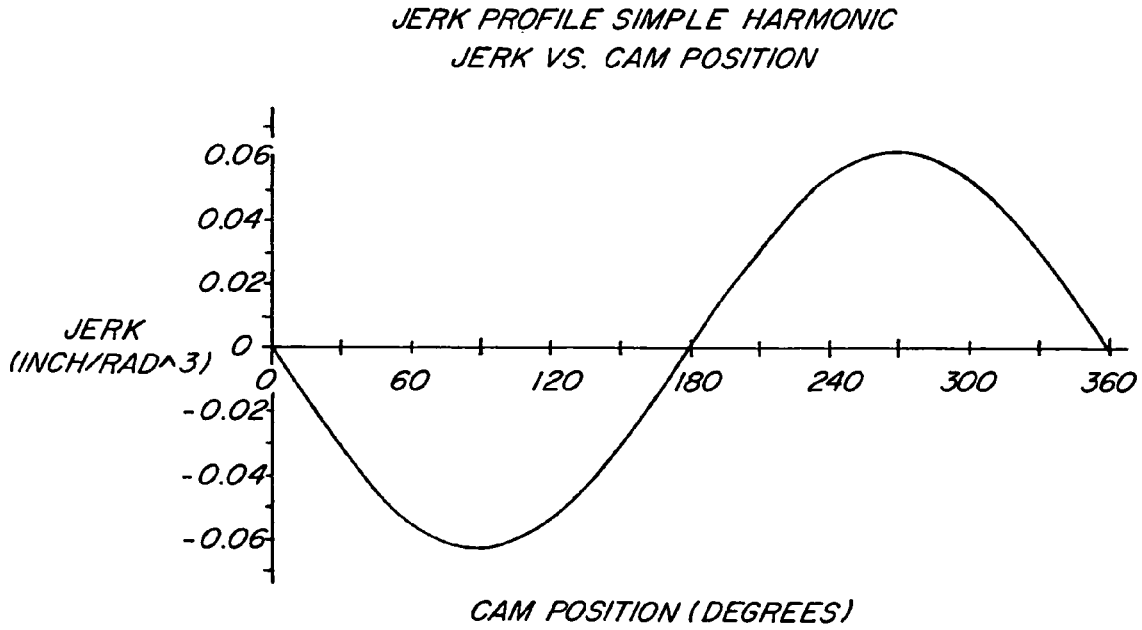
FIG. 6 is a simplified graphical representation of a jerk profile for a simple harmonic cam profile.
Figure 8:
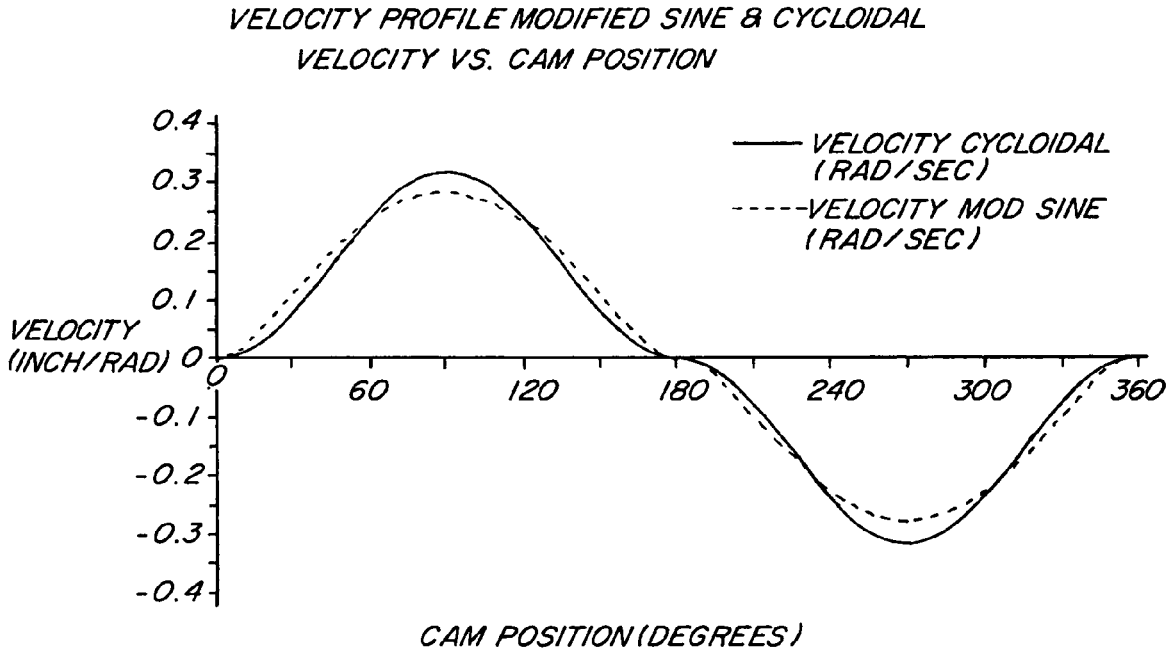
FIG. 8 is a simplified graphical representation of velocity profiles for modified sine and cycloidal cam profiles.
Figure 9:
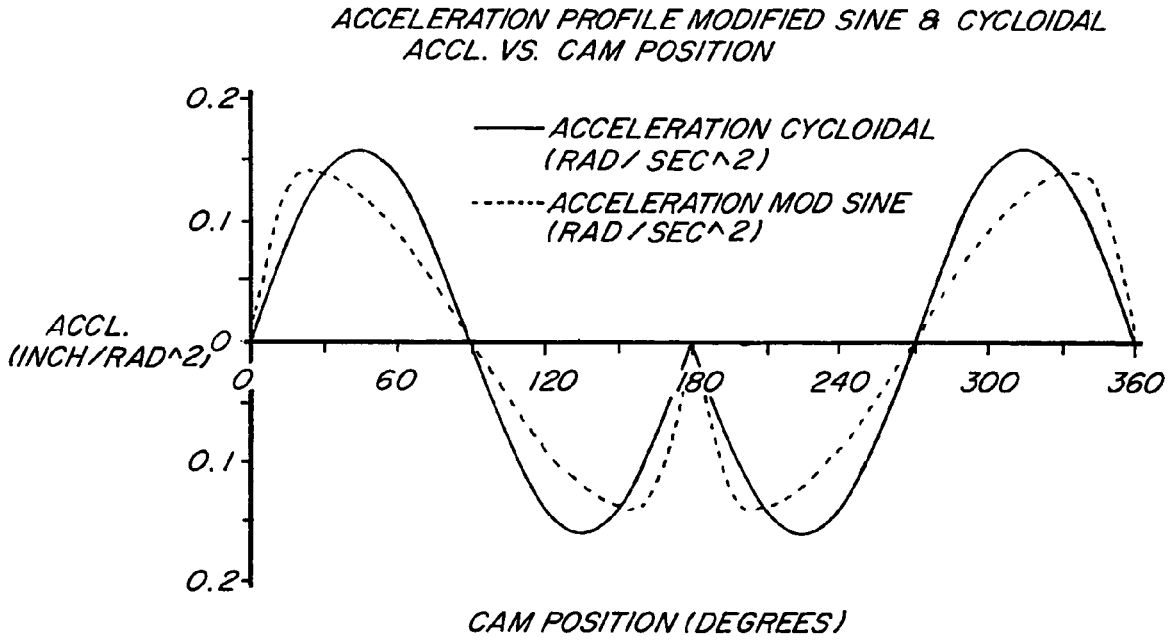
FIG. 9 is a simplified graphical representation of acceleration profiles for modified sine and cycloidal cam profiles.
Figure 10:
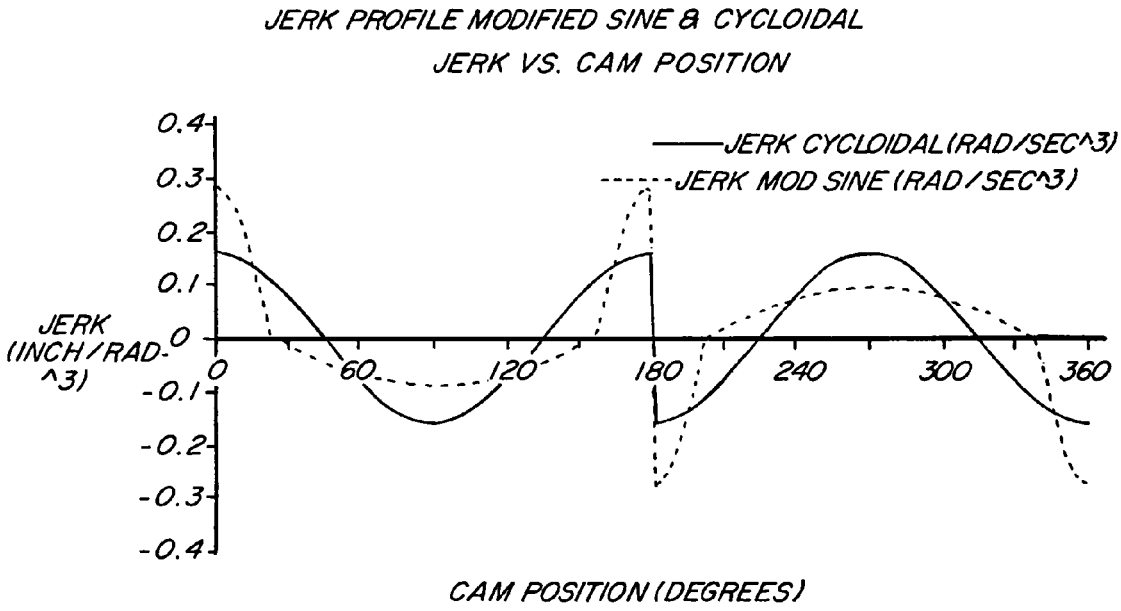
FIG. 10 is a simplified graphical representation of jerk profiles for modified sine and cycloidal cam profiles.
Figure 11:
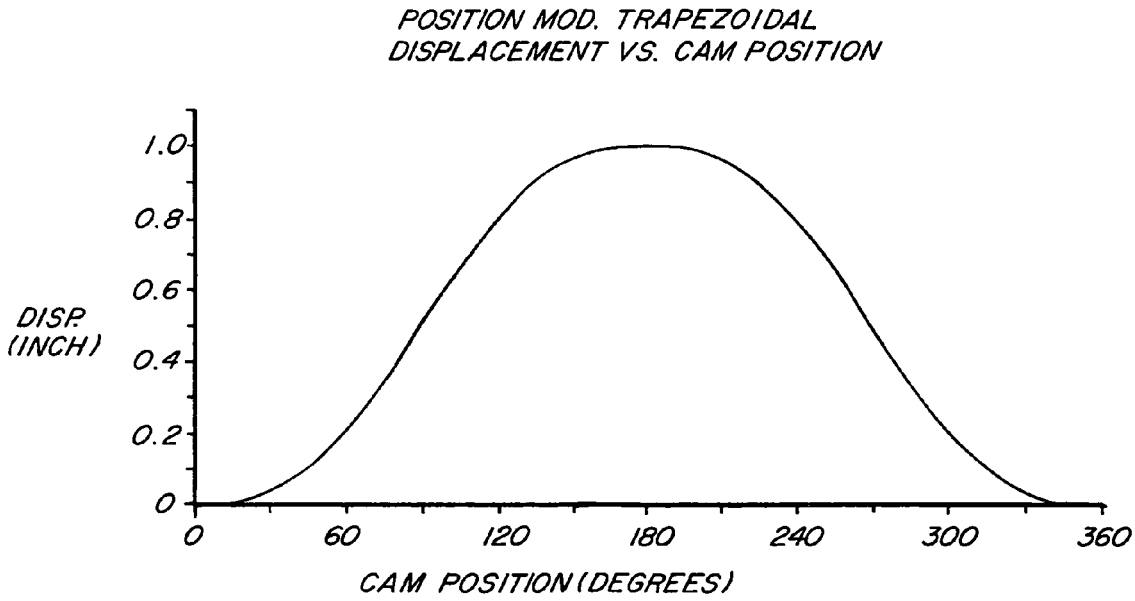
FIG. 11 is a simplified graphical representation of a position profile for a modified trapezoidal cam profile.
Figure 12:
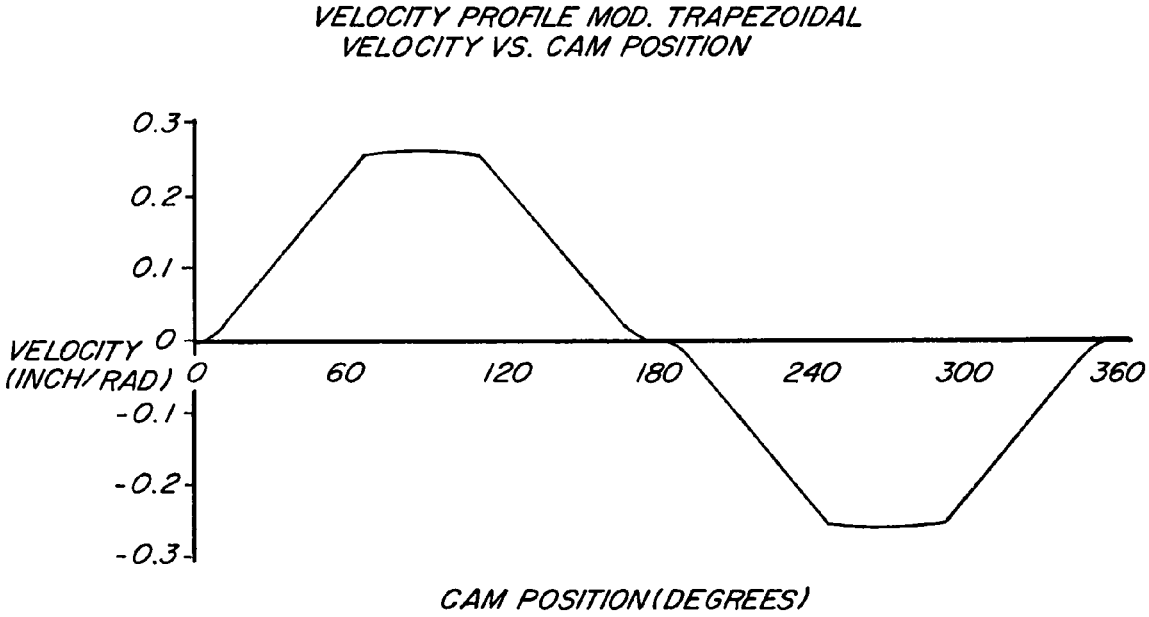
FIG. 12 is a simplified graphical representation of a velocity profile for a modified trapezoidal cam profile.
Figure 13:
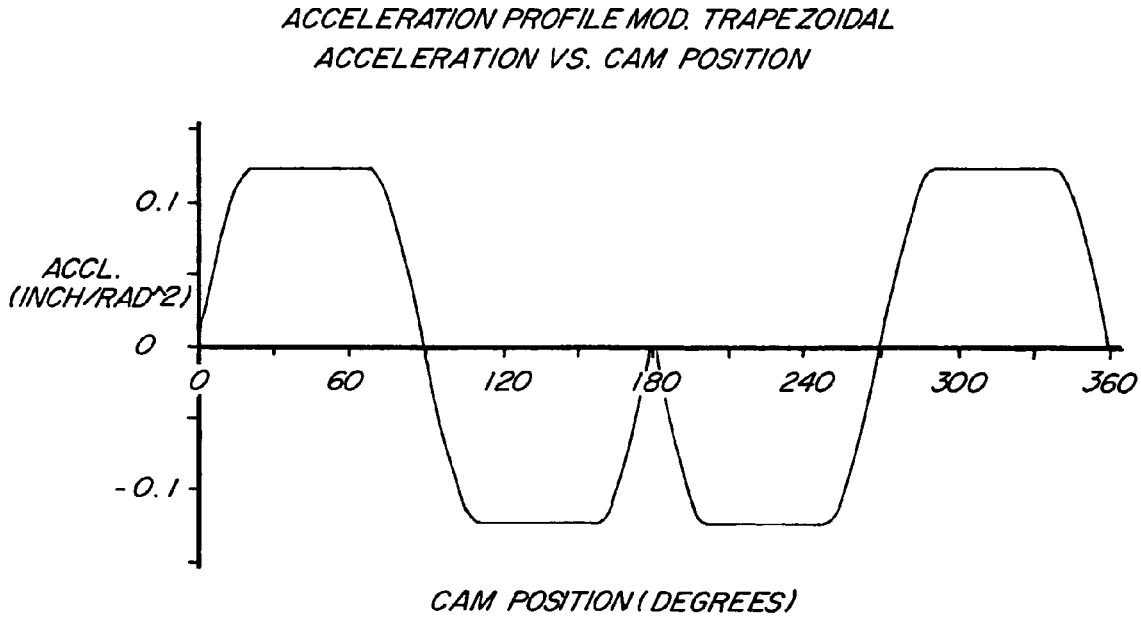
FIG. 13 is a simplified graphical representation of an acceleration profile for a modified trapezoidal cam profile.
Figure 14:
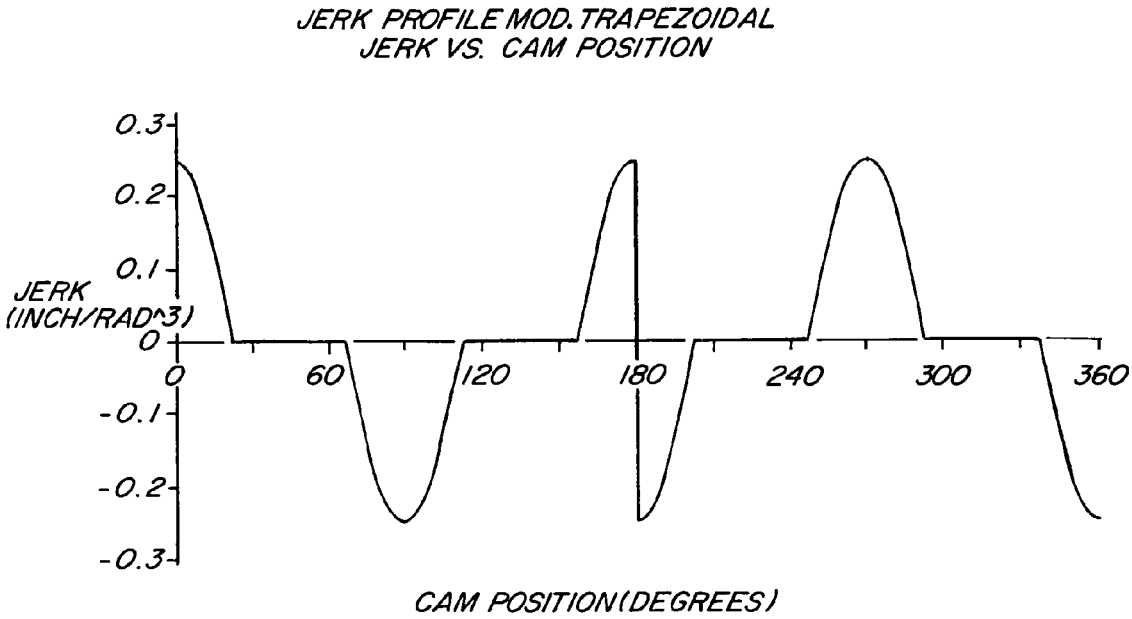
FIG. 14 is a simplified graphical representation of a jerk profile for a modified trapezoidal cam profile.
Figure 15:
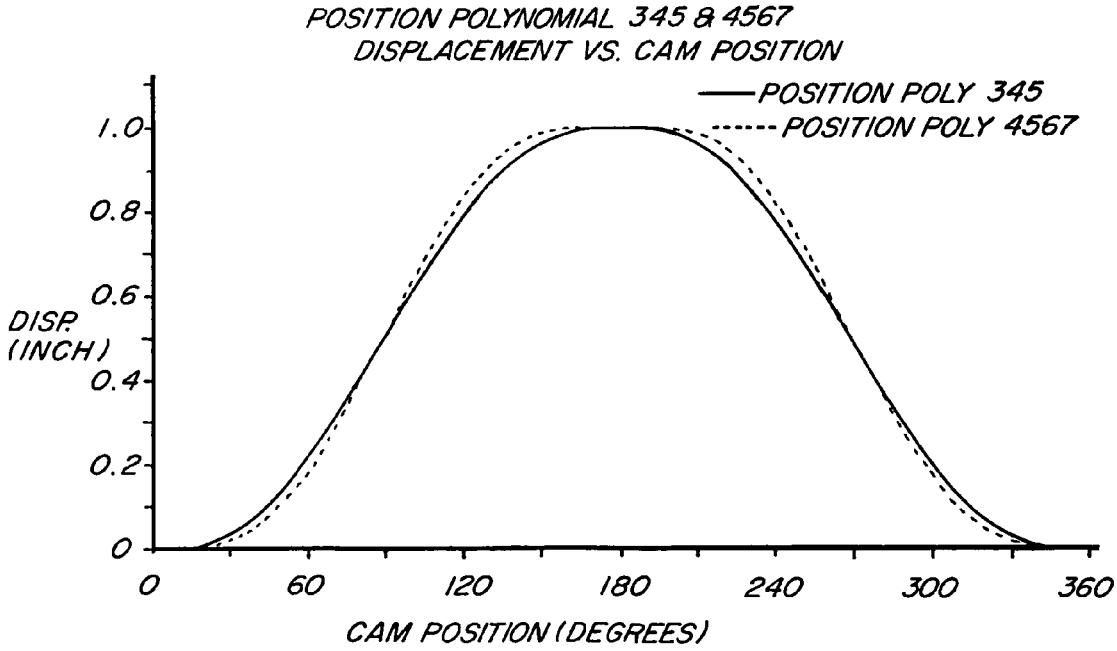
FIG. 15 is a simplified graphical representation of position profiles for 345 and 4567 polynomial cam profiles.
Figure 16:
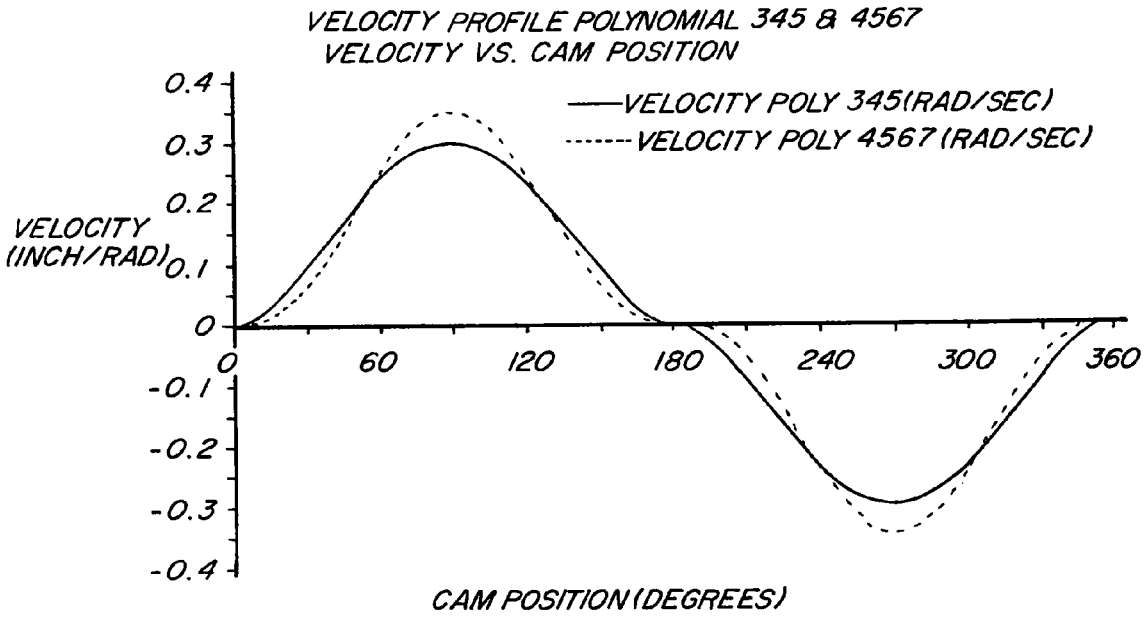
FIG. 16 is a simplified graphical representation of velocity profiles for 345 and 4567 polynomial cam profiles.
Figure 17:
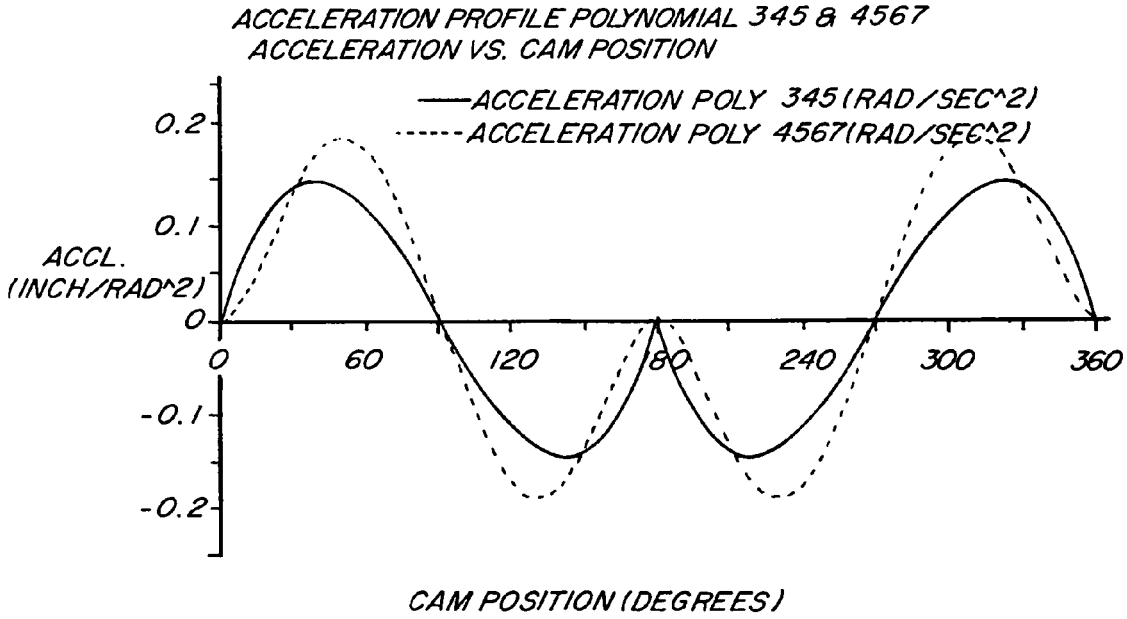
FIG. 17 is a simplified graphical representation of acceleration profiles for 345 and 4567 polynomial cam profiles.
Figure 18:
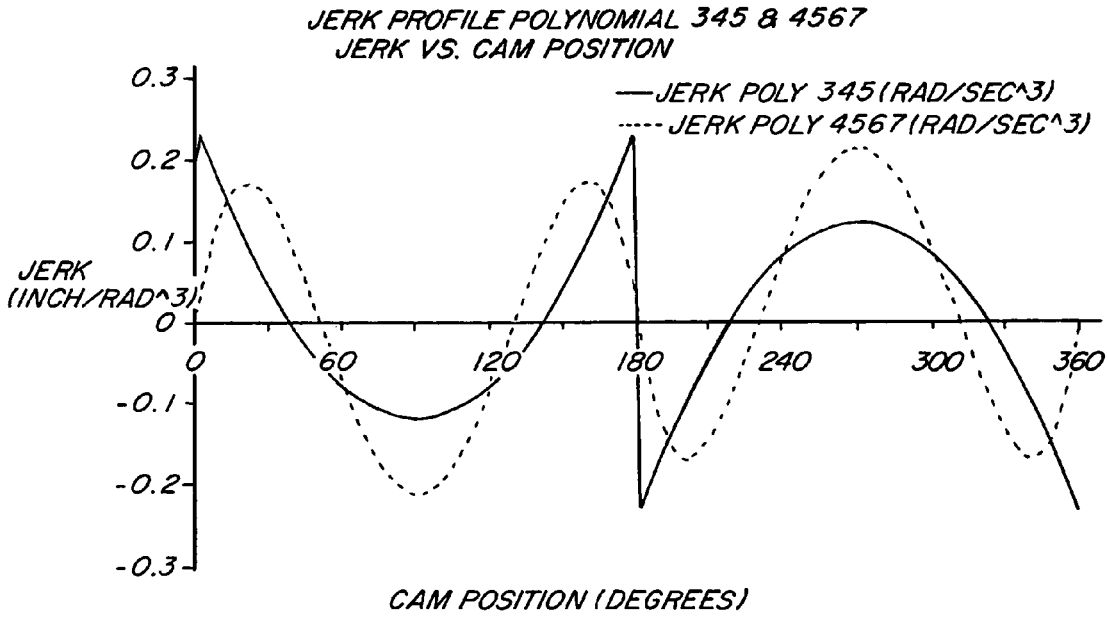
FIG. 18 is a simplified graphical representation of jerk profiles for 345 and 4567 polynomial cam profiles.
Figure 19:
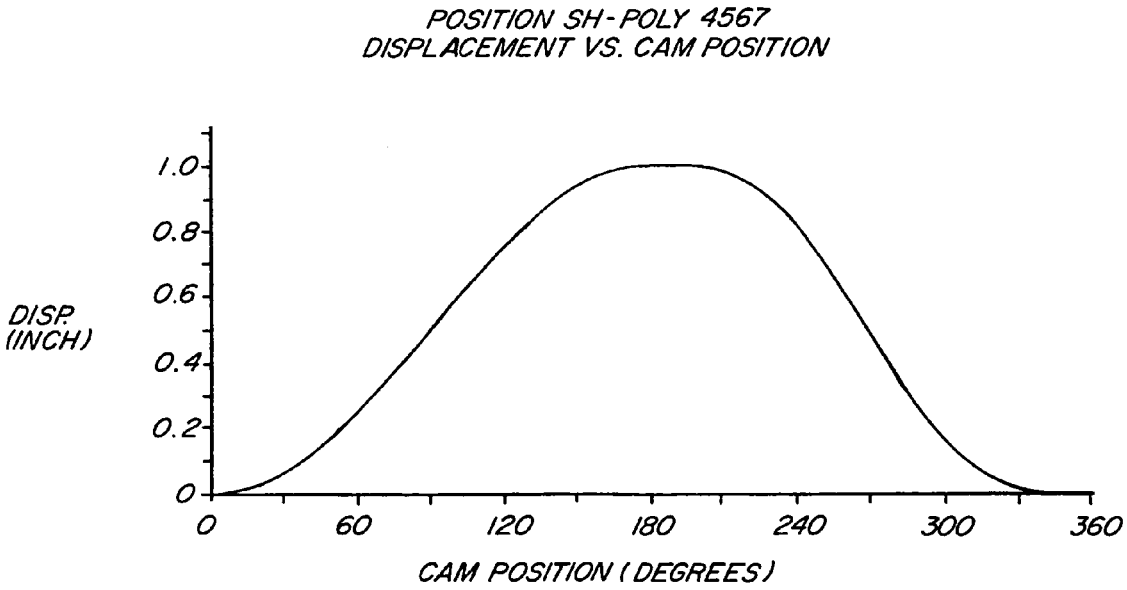
FIG. 19 is a simplified graphical representation of a position profile for mixed simple harmonic and 4567 polynomial cam profiles.
Figure 20:
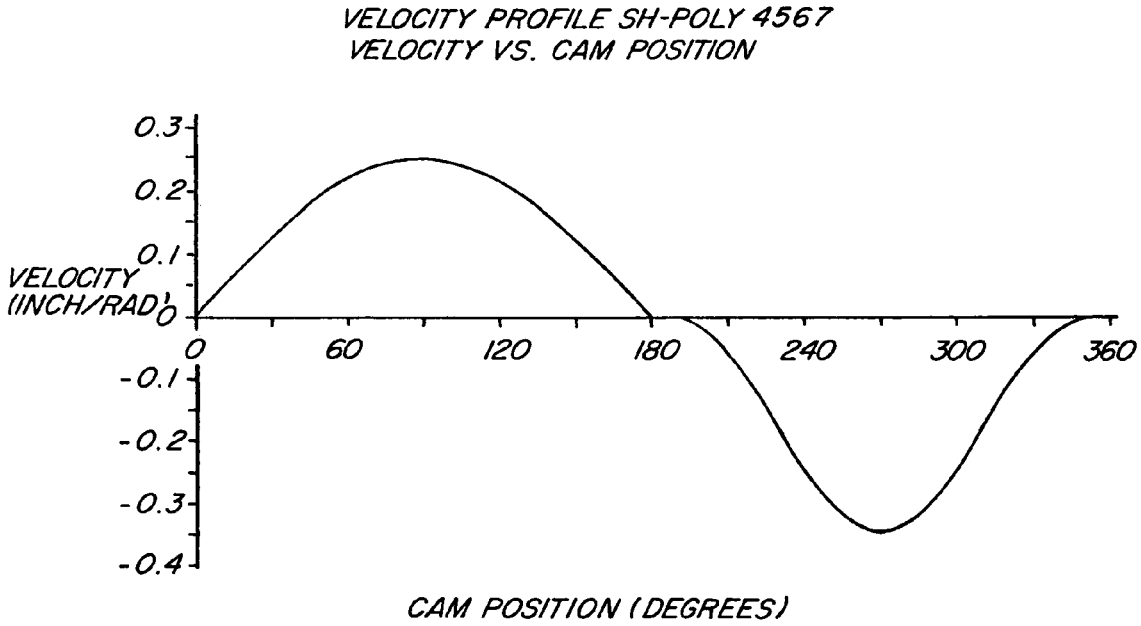
FIG. 20 is a simplified graphical representation of a velocity profile for mixed simple harmonic and 4567 polynomial cam profiles.
Figure 21:
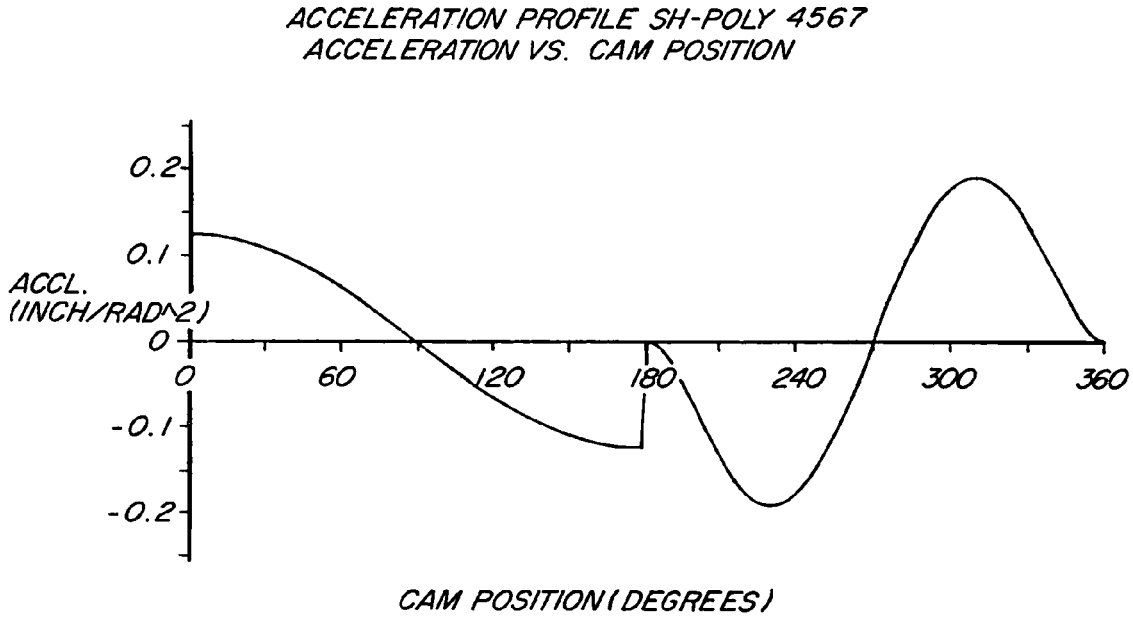
FIG. 21 is a simplified graphical representation of an acceleration profile for mixed simple harmonic and 4567 polynomial cam profiles.
Figure 22:
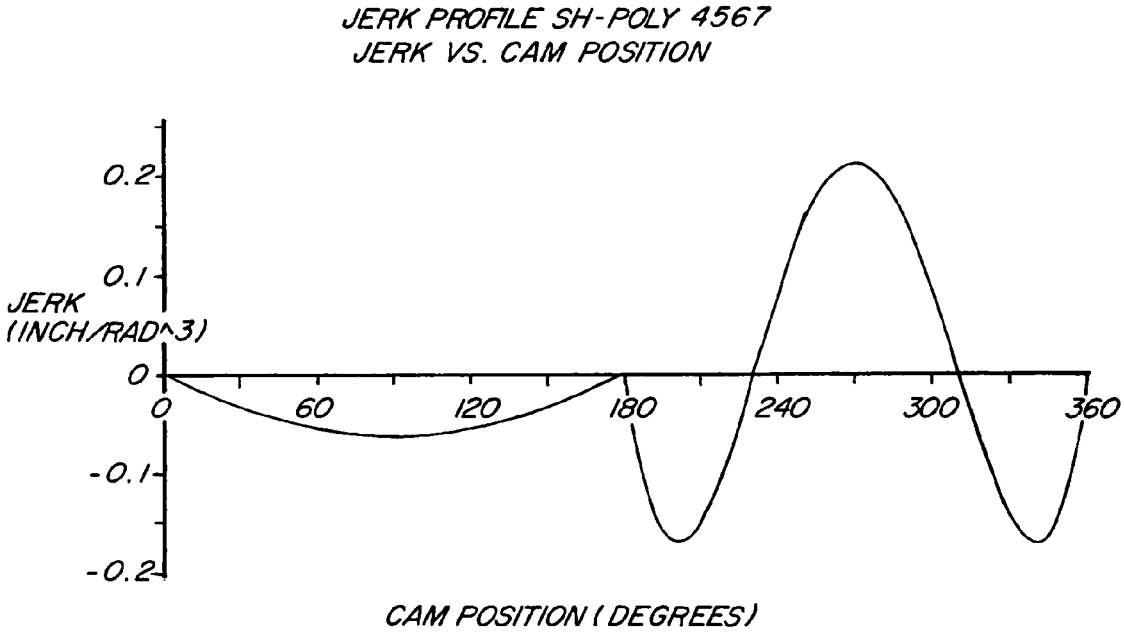
FIG. 22 is a simplified graphical representation of a jerk profile for mixed simple harmonic and 4567 polynomial cam profiles.

Referring now more particularly to the drawings, aspects of preferred embodiments of the invention will be discussed in greater detail. According to the present invention, there are an unlimited number of cam profiles to be used as operating profiles for control of a honing stroke. For example the following cam profiles will be compared: Simplified Harmonic, Cycloidal, Modified Sine, Modified Trapezoidal, Polynomial 345 and Polynomial 4567. Referring to FIGS. 3, 4, 5 and 6, profiles of displacement, velocity, acceleration and jerk verses cam position for the Simple Harmonic cam profile already used as a motion profile in Sunnen's linkage driven honing machines, are shown. As shown in FIGS. 4, 5 and 6, the Simple Harmonic profile produces minimum acceleration with smooth velocity, acceleration and jerk profiles. Therefore it is recommended for small stroke settings where the reciprocation cycles per minute will be high. Given the smooth jerk profile, the vibrations produced by the motion are very small. In short cyclic motion, this profile offers the most controllable outputs. The inertia input will be consistent for horizontal applications.

Referring also to FIGS. 7, 8, 9 and 10, profiles of displacement, velocity, acceleration and jerk verses cam position for Modified Sine and Cycloidal cam profiles are shown. These profiles have very smooth velocity profiles. The acceleration and jerk profiles are consistent and their peaks are small in magnitude. They offer a very good compromise to replace the Simple Harmonic profile.

Referring also to FIGS. 11, 12, 13 and 14, profiles of displacement, velocity, acceleration and jerk for a Modified Trapezoidal cam profile are shown. Here it should be noted that the Modified Trapezoidal profile has a limited range in the acceleration and jerk. The benefits of this profile are related to hard parametric limits (maximum velocity and acceleration are set by the mechanical system, maximum output constraints by mechanical limits). The control scheme is simplified given the only possible variable is the stroke length. The possible rate will be determined by the hard limits of speed and acceleration. It also offers a fast control scheme by reducing the variable set.

Referring also to FIGS. 15, 16, 17 and 18, profiles of displacement, velocity, acceleration and jerk for two representative polynomial cam profiles which are a 345 polynomial profile and a 4567 polynomial profile, are shown. Here, it can be noted that the benefit of the polynomial profile is that it can be controlled with the boundaries conditions (initial and final conditions, initial acceleration=0, final acceleration=0 . . . ). This system is well suited to optimize relational constraints such as tool performance under specific velocity, or acceleration limits. An example of this is the matching of the acceleration profiles for a vertical application, where the influence of gravity can be significant. In cases were tandem bores are being honed, the profile can be modified to optimize material removal in the bore hone areas at the same time that cycle time be reduced.

Referring also to FIGS. 19, 20, 21 and 22, samples curves representative of mixed cam profiles that can be used to improve performance of tool or machine components are shown. Here, the mix is a simple harmonic profile and a 4567 polynomial profile. As an example application, this mixed profile can be used for a honing tool with a very large ratio between bore diameter and tool length which will be weak under compression loads. Therefore the output will be limited by the maximum buckling loads added to the shear limits.

The present Servo Stroking System is based on the optimization of the stroking process in honing, using the already existing machine tool components. These tools are the following: Servo Control, Digital Control and linear motion system (ball screw, roller screw, linear servomotor, rack and pinion, hydraulic cylinder, chain, belt). The optimization is related to three main groups: honing output (surface finish, bore geometry, part cycle), honing tool (tool geometry, work loads), honing machine components (work loads, life cycles).

Figure 23:
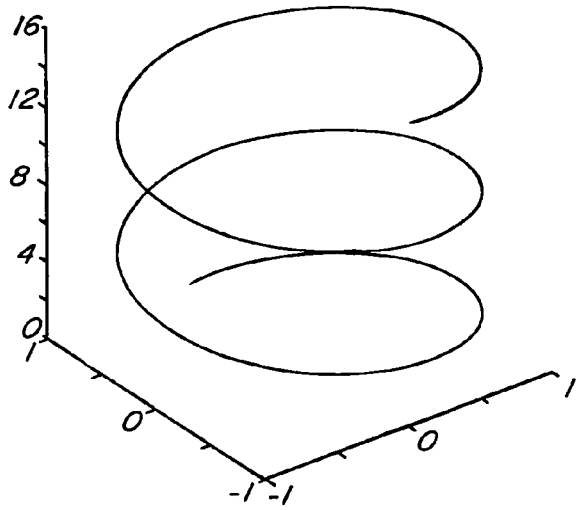
FIG. 23 is a simplified three-dimensional graphical representation of a path of an abrasive grain as a result of stroking and rotation during a honing operation.

The total throughput in a honing machine is controlled by the following elements:

Stroker (stroker rate, motion profile)
Spindle rate (RPM)
Feed Rate (tool expansion rate, force expansion rate)
Coolant selection
Abrasive selection These elements are integrally related to the honing process and desired outcome. The optimum performance of the process is not established and will be different for every specific part to be honed. The system variables are sub grouped into machine control components: stroker, spindle and feed system and tool components: coolant and abrasives. This subdivision establishes a system dependency, relating the tool variables as constraints (defining abrasives and coolant as honing part delimiters, related to surface finish and material removal interactions). These relations only offer the motion control components as possible optimization parameters. For many applications, the main point of optimization is the minimization of the abrasive use with respect to the maximum material removal, producing a minimum production cycle time. This process is independent of the crosshatch angle. The desired cross hatch angle is related to the final section of the honing process. The physical displacement of an abrasive grain throughout the bore produces a helix, as shown in FIG. 23.

Figure 24:
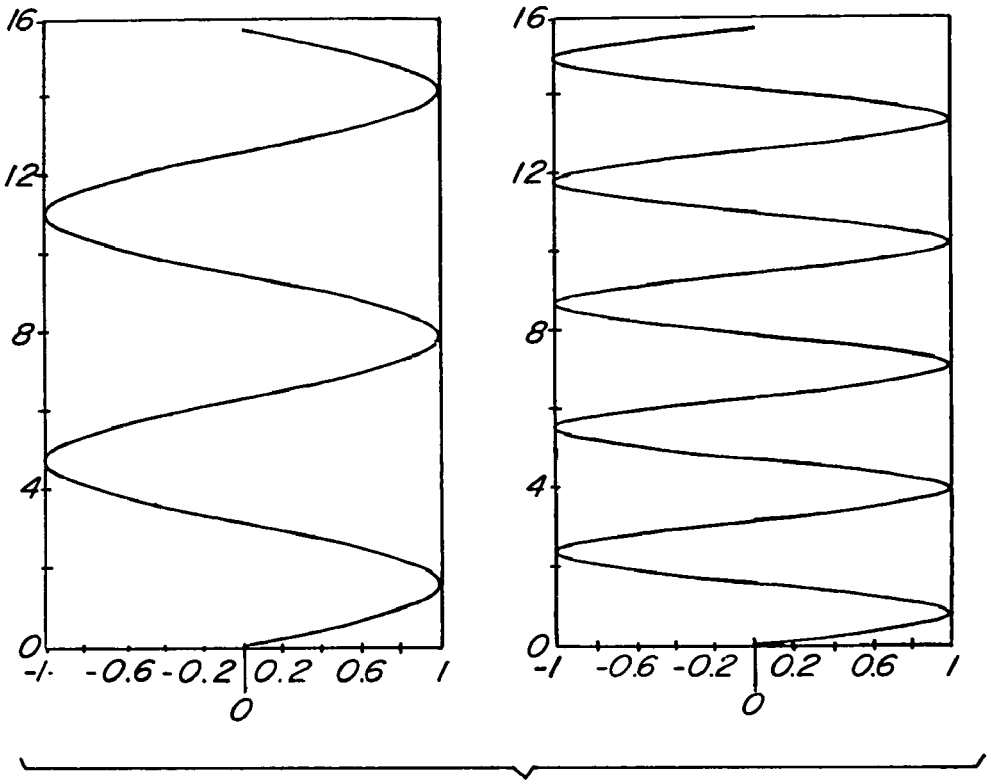
FIG. 24 is a pair of two-dimensional graphical representations of helical grain paths for different stroker rates.

FIG. 24 shows two dimensional representations of a helix to illustrate the difference in grain path produce by varying stroker rate and keeping the spindle rate constant. The left hand representation is of a faster stroker rate. The right hand representation is of a slower stroker rate.

Here, it should be noted the rotation of a honing tool can also be controlled so as to also follow any cam profile, such as any of those listed above, namely, a simplified harmonic, modified sine, trapezoidal, polynomial, and/or mixed cam profile. And, the cam profile or profiles of the rotation can be coordinated with that of the stroking motion of the tool, for instance to produce a desired cross hatching pattern. In this regard, utilizing the same cam profile for both stroking and rotation of a tool, timed to coincide, has been found to produce a cross hatching pattern which is more uniform along the length of a honed surface.

Figure 25:
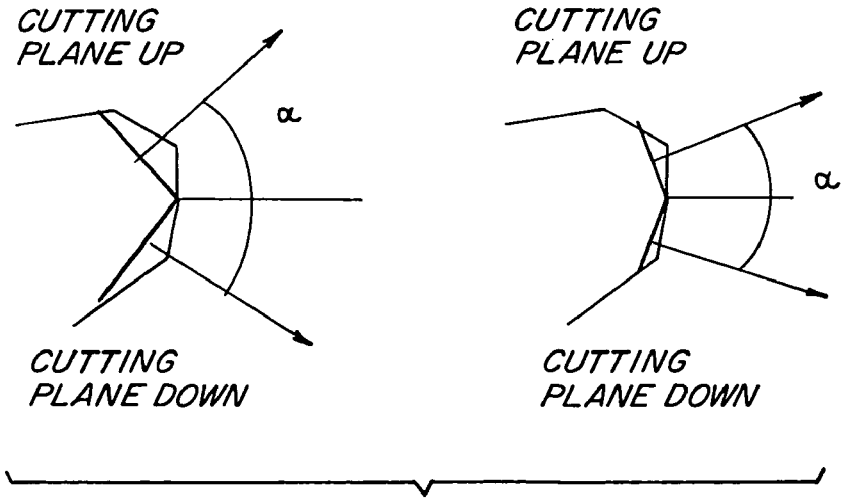
FIG. 25 is a pair of simplified schematic representations of an abrasive grain, illustrating effects of different grain path angles.

Referring to FIG. 25, two illustrations of a representative abrasive grain are shown. Arrows are shown superimposed on each of the representations to represent the grain path for upward and downward stroking motions, respectively. The grain paths are normal to cutting planes on the grain for the upward and downward stroking motions. These planes are depending of the stroking direction. Therefore there will be two cutting planes for the same abrasive grain. The total length of the cutting edge in a two dimensional representation is directly proportional to the path angle between the two stroking directions, represented by the symbol $\alpha$.

The most significant benefit that is observed of a greater path angle $\alpha$ is the increased surface in the cutting plane of the abrasive grain. Therefore a more aggressive feed force is admissible given the homogeneous distribution along the grain surface. The results are shorter cycles and improved abrasive efficiency or performance. If the feed force is kept constant, the increase in the stroke rate will modify the cutting plane orientation until an optimum angle $\alpha$ is found on the abrasive grain. This angle will produce the best result when the grain is self sharpening by the honing process.

Figure 26:
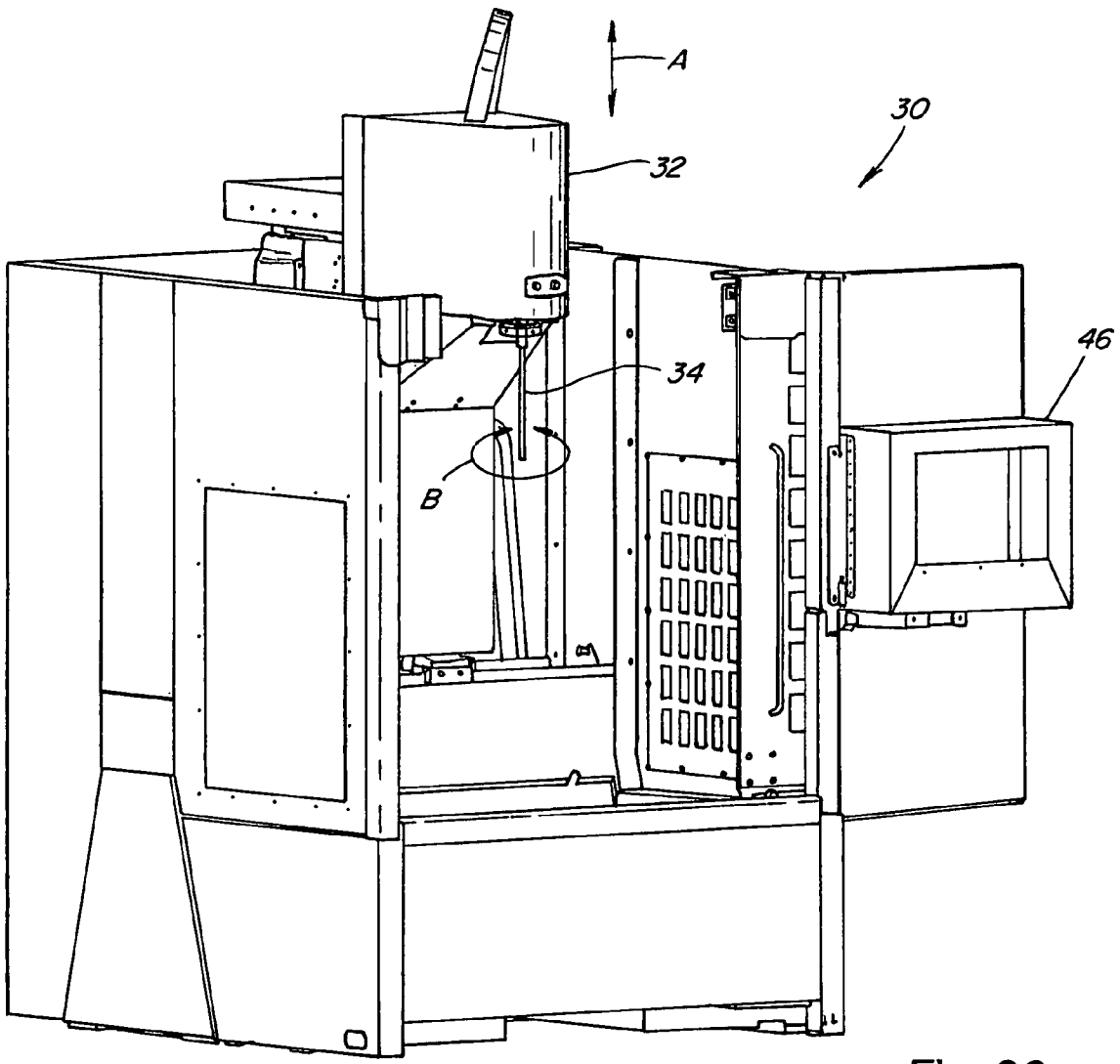
FIG. 26 is a simplified perspective view of a honing machine according to the invention.

In FIG. 26, a honing machine 30 is shown including aspects of a servo controlled stroking apparatus and system according to the present invention. Honing machine 30 generally includes a spindle carriage 32 which is movable in a reciprocating stroking action, denoted by arrow A, according to the present invention by a linear motion system such as the ball screw, roller screw, linear servomotor, rack and pinion, hydraulic cylinder, chain, or belt mentioned above. Here, carriage 32 is shown supported for reciprocal stroking action in a vertical direction, but it should be understood that stroking in other directions is also contemplated under the present invention. Spindle carriage 32 includes a honing tool 34, which can be of conventional or new construction and operation, generally including an elongate mandrel carrying one or more abrasive stones or sticks which can be moved radially outwardly and inwardly relative to the mandrel, and which abrade and hone a surface of a work piece in which tool 34 is inserted, as tool 34 is rotated, as denoted by arrow B. In a typical application, as spindle carriage 32 is reciprocally stroked upwardly and downwardly, as denoted by arrow A, honing tool 34 will rotate in one direction or the other, as denoted by arrow B, within a hole or bore in a work piece, for providing a desired surface finish and shape to one or more surfaces defining the bore or hole.

Figure 27:
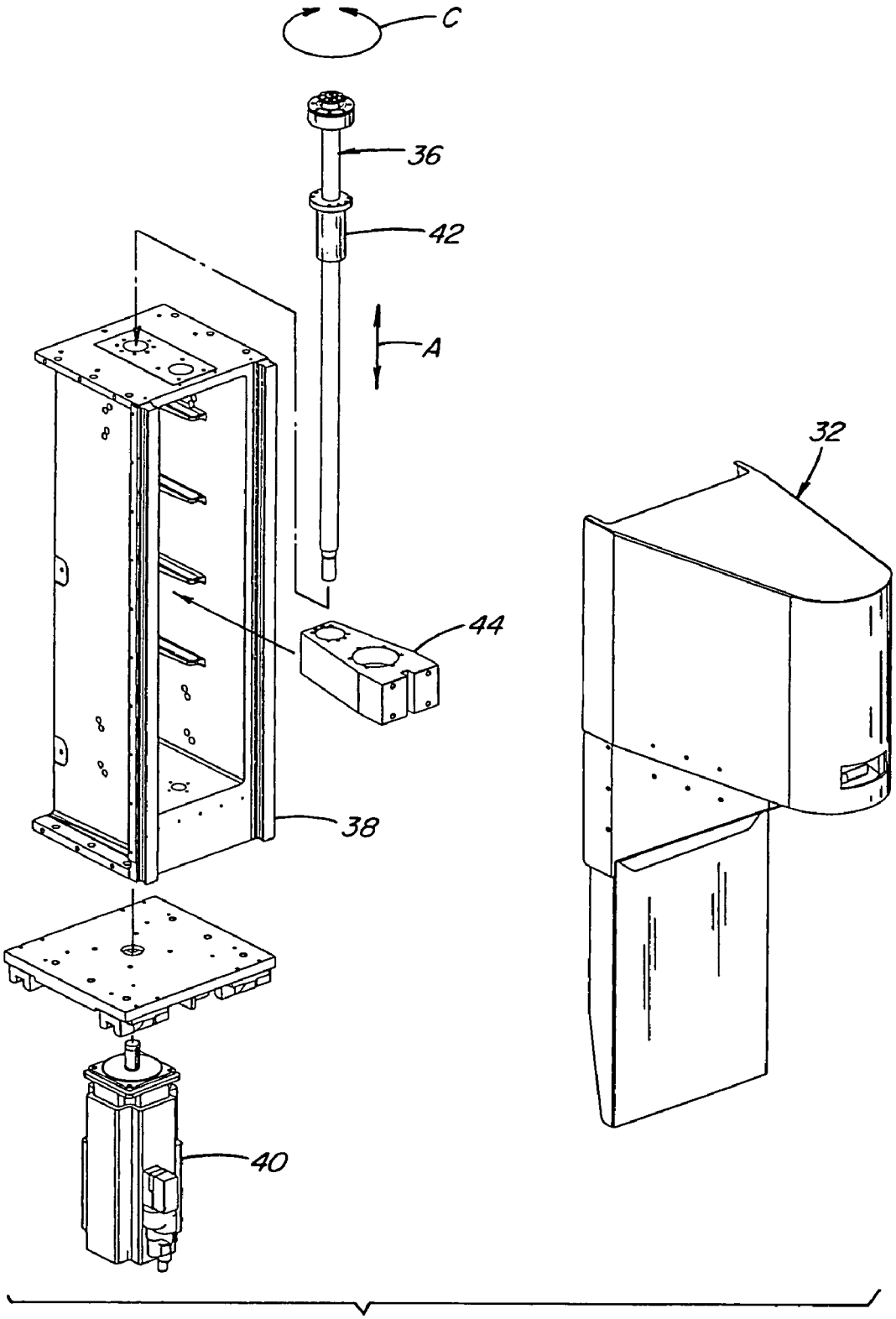
FIG. 27 is a simplified exploded representation of stroking apparatus of the machine of FIG. 26.

FIG. 27 shows a preferred servo controlled stroking apparatus for spindle carriage 32 of honing machine 30, including a preferred servo controlled linear motion system or drive mechanism therefore, which includes a ball screw 36 which is supported in a ball screw housing 38 for rotation, as denoted by arrow C. Ball screw 36 is precisely rotatable according to the teachings of the present invention, by a servo motor 40, the number of rotations of and the rotational position of which being precisely detectable by an encoder (not shown) or other sensor. A ball nut 42 is moved longitudinally along ball screw 36 by the rotation thereof, as denoted by arrow A, and from the rotation count of ball screw 36 the longitudinal position of ball nut 42 is determined. A spindle support 44 is mountable to ball nut 42 and supports spindle carriage 32 for movement with nut 42 in direction A for producing the stroking action according to the invention. Referring again to FIG. 26, servo motor 40 is controllable by a processor based controller 46 for stroking spindle carriage 32 and honing tool 34 in accordance with any of the curves shown in FIGS. 3-22 herein.

Figure 28:
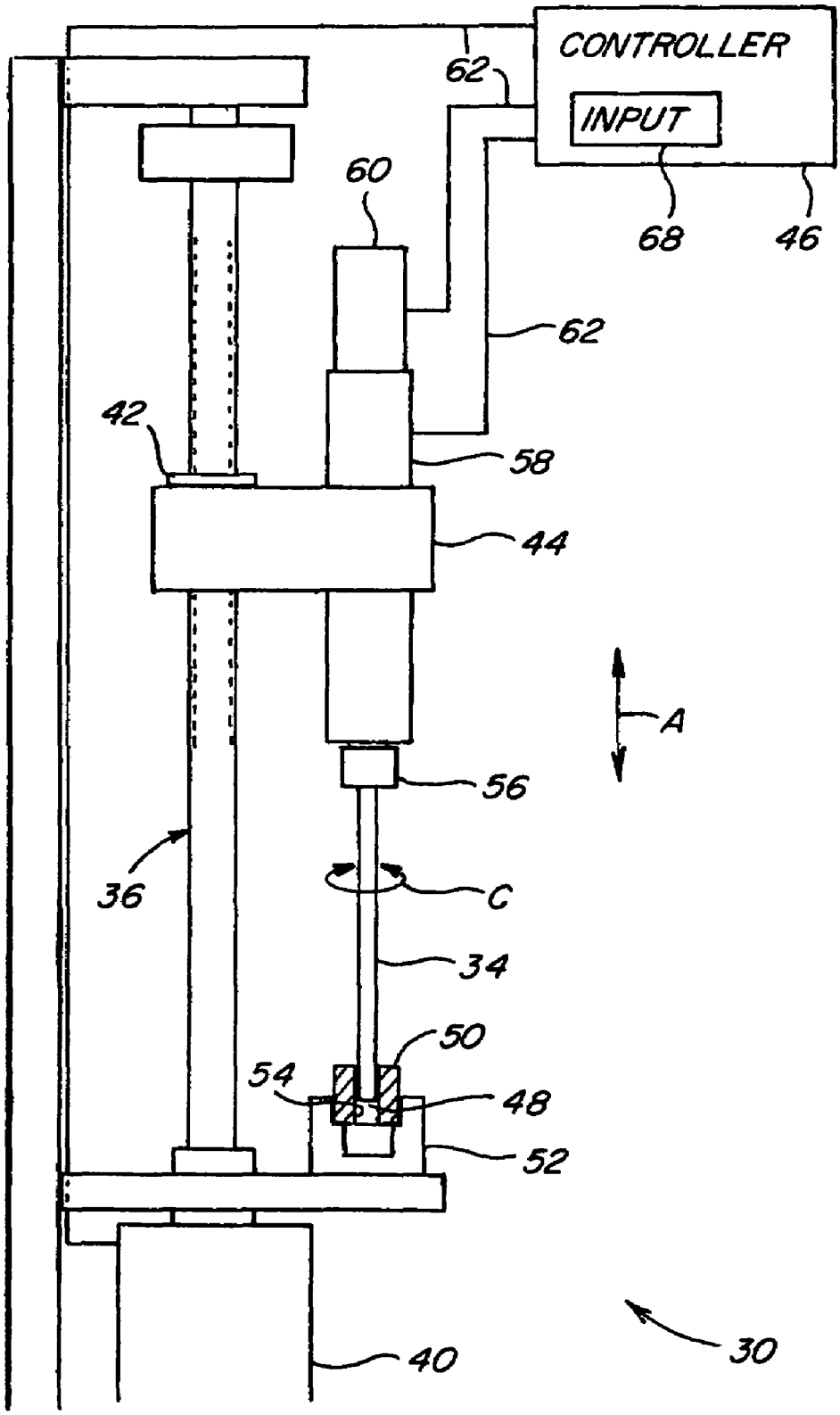
FIG. 28 is a simplified schematic side view of the stroking apparatus of the honing machine of FIG. 26.

Referring also to FIG. 28, a simplified schematic representation of the stroking apparatus of honing machine 30 is shown. Here, tool 34 is shown inserted into a bore 48 of a work piece 50 held in a fixture 52 of machine 30, for honing an internal surface 54 of work piece 50 defining bore 48. Honing tool 34 is supported by a rotatable spindle 56 for the reciprocal movement denoted by arrow A, and rotation denoted by arrow C, for effecting desired honing of surface 54 of work piece 50. Spindle 56 is rotatably driven by a drive 58 in the well known manner. Honing tool 34 is radially expanded and retracted by a drive 60, also in the well known manner. Spindle 56 supporting tool 34, as well as drives 58 and 60, are supported on spindle support 44 connected to ball nut 42, so as to be movable longitudinally along ball screw 36 as effected by rotation of servo motor 40 in connection therewith.

As noted previously, an encoder or other device can be utilized for counting rotations of ball screw 36 for determining a longitudinal position of ball nut 42 therealong and thus the longitudinal position of honing tool 34 in a work piece such as work piece 50. From this information that the longitudinal position of tool 34 is determined, and with information relating to the timing of changes in the longitudinal position, velocity, acceleration, and jerk of ball nut 42 and tool 34 can be precisely controlled so as to follow a desired cam profile, such as any of those illustrated in the figures just discussed, as precisely controlled by controller 46. Here, controller 46 is shown connected by conductive paths 62 to servo motor 40 and also drives 58 and 60, for controlling the linear position, velocity, acceleration and jerk profiles of tool 34, and also the direction and speed of rotation of tool 34 through drive 58, as well as the radial expansion and contraction thereof as effected through drive 60.

Figure 29:
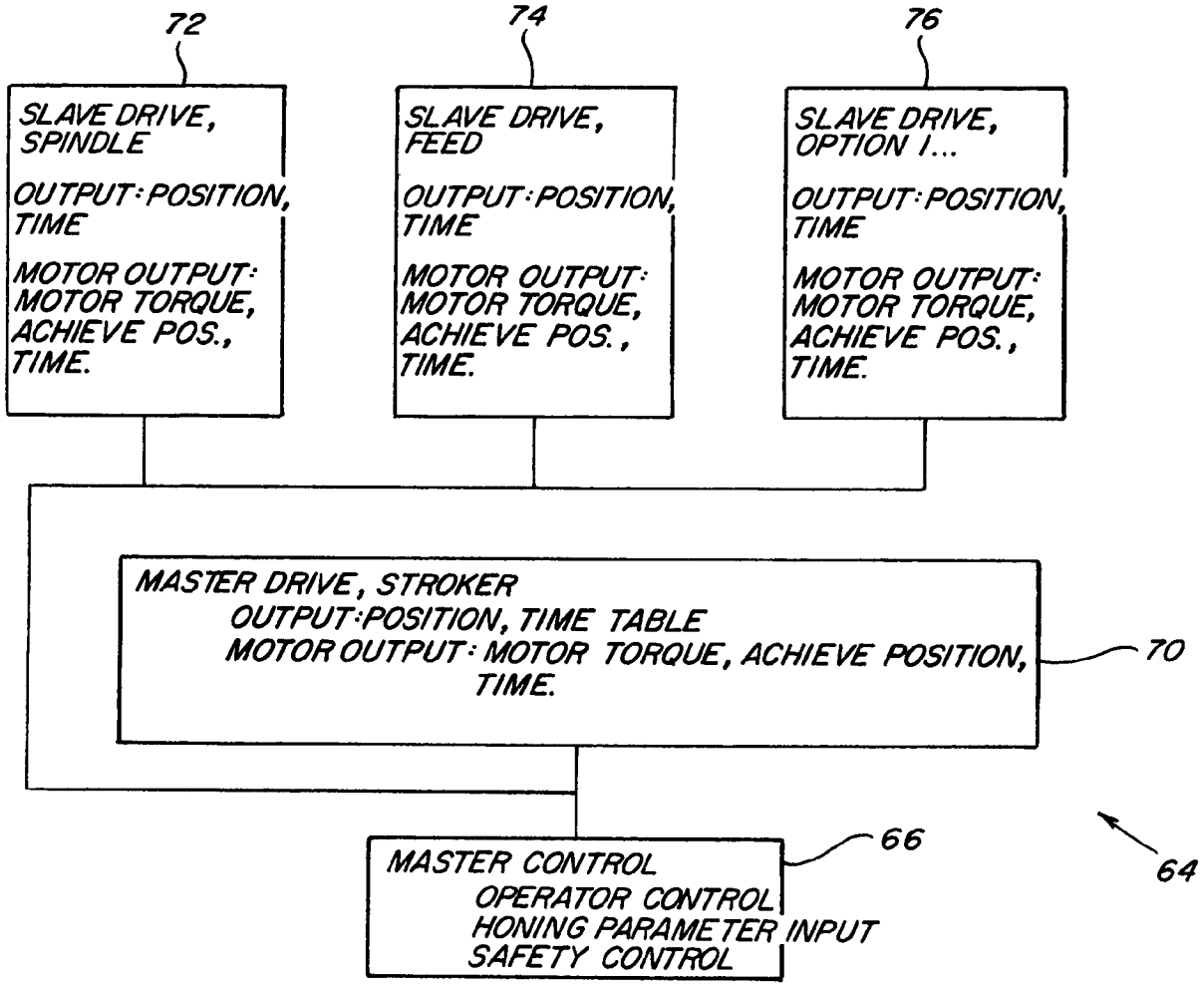
FIG. 29 is a simplified diagrammatic representation of elements of the honing machine of FIG. 26.

Referring also to FIG. 29, a diagrammatic representation 64 of a scheme for controlling operation of honing machine 30 is shown. In diagram 64, block 66 represents functions of controller 46 including operator control, and honing parameter input, as effected by inputs received through an input device 68 of controller 46, which can be a touch screen and/or a keyboard, and/or any other common commercially available operator controllable input devices. Functions of servo motor 40 are represented by block 70 and include position outputs for controlling and determining position, velocity, acceleration and jerk of honing tool 34 in the above described manner. Block 72 represents functions of spindle drive 58, including position and time outputs, and motor outputs including motor torque, achieve position, and time, in relation to operational parameters of spindle 56. Block 74 illustrates functions in relation to drive 60 for effecting expansion and contraction or feed of the honing elements of tool 34 as effected by drive 60, including position and time outputs, and motor outputs including motor torque, achieve position, and time. Block 76 represents functions of one or more optional drives of machine 30.

Figure 30:
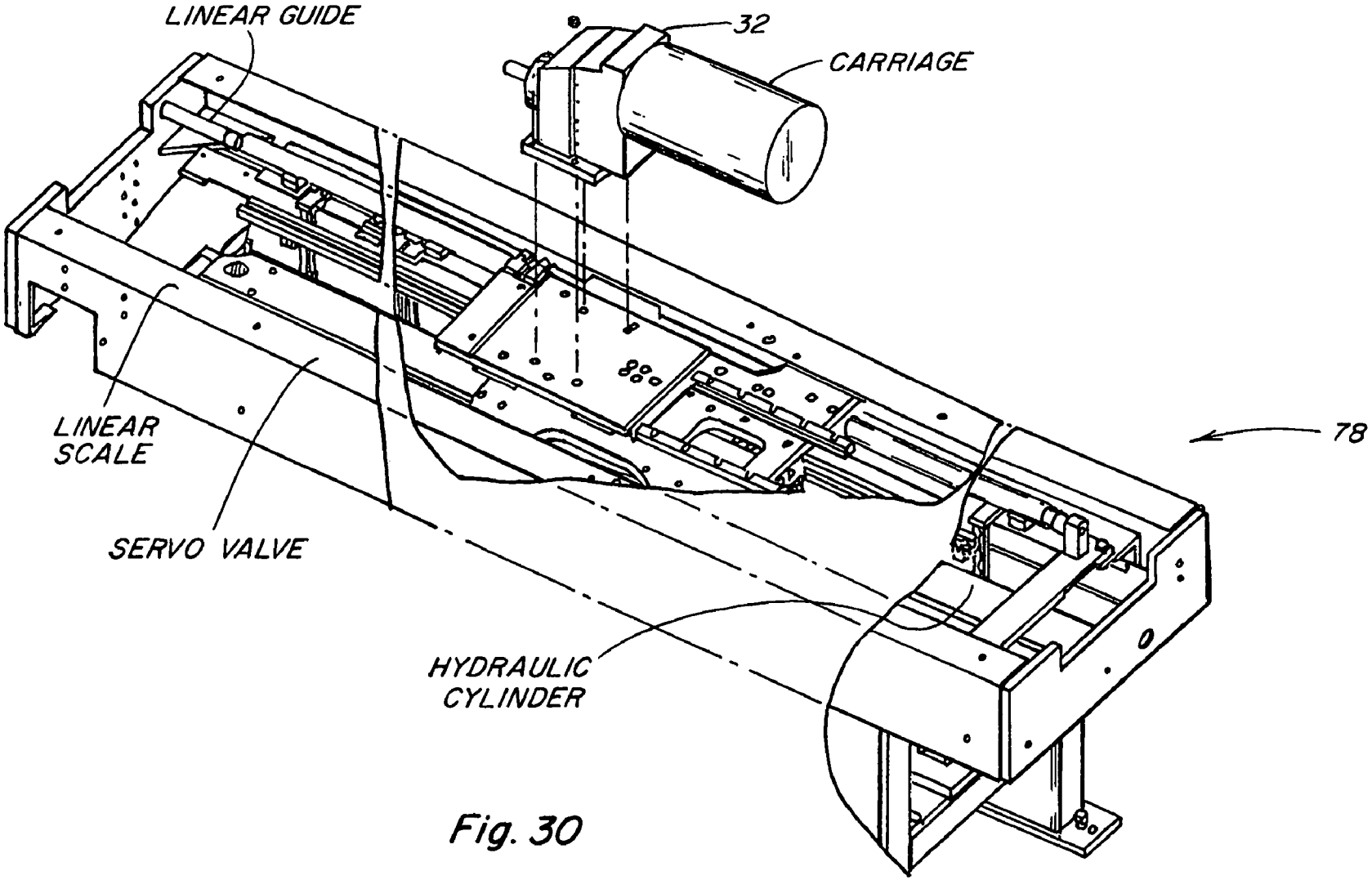
FIG. 30 is a simplified perspective view of alternative stroking apparatus for a honing machine according to the invention, the apparatus including a servo controlled fluid cylinder.

Referring also to FIG. 30, alternative servo controlled stroking apparatus 78 for the spindle carriage 32 of a honing machine, such as honing machine 30, is shown. Apparatus 78 includes a servo controlled linear motion system which utilizes a hydraulic cylinder as the linear motion driver for carriage 32, as controlled by a servo valve. Longitudinal position of carriage 32 is determined by a linear scale or encoder and the linear motion is controlled by a linear guide.

Figure 31:
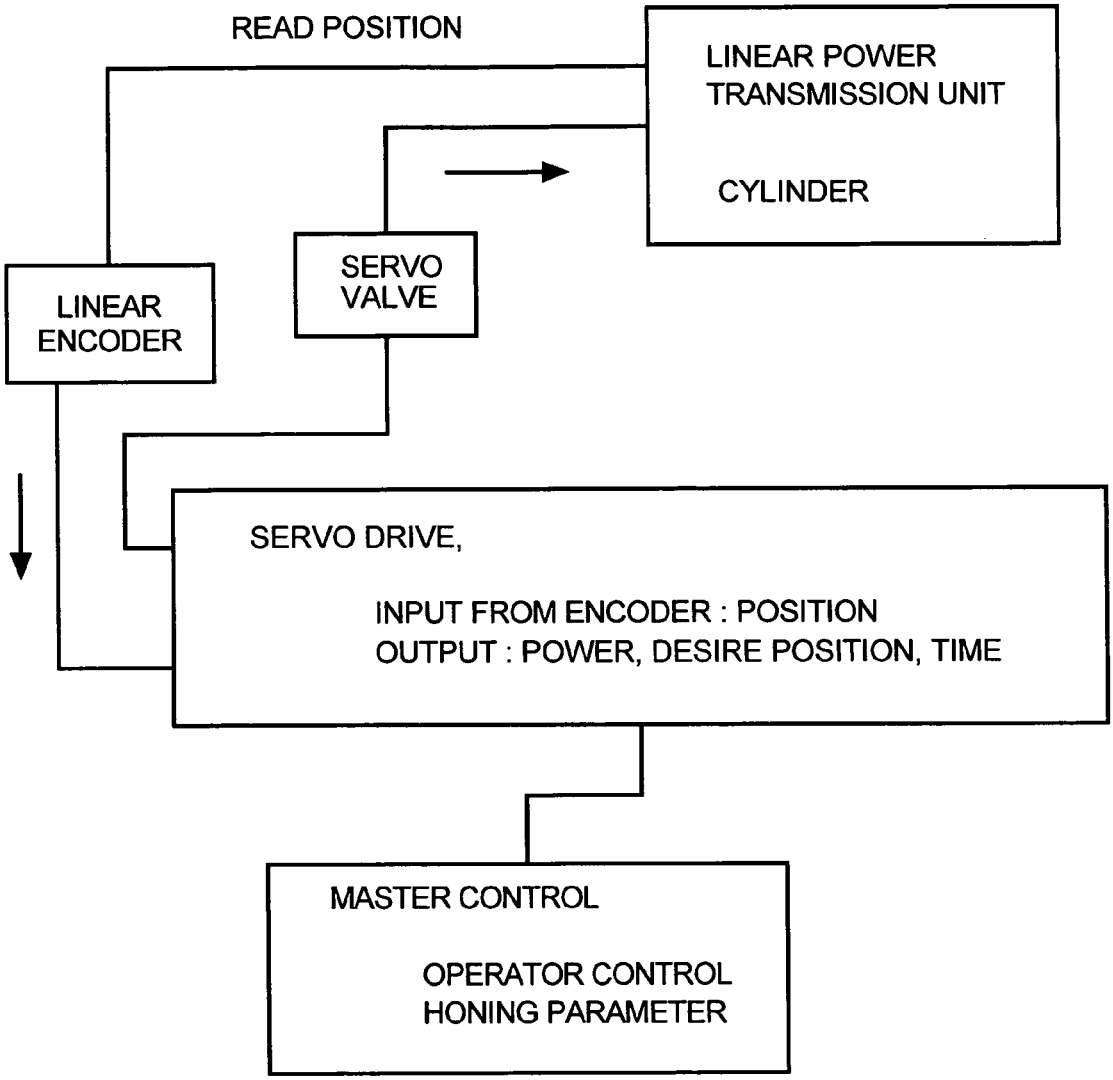
FIG. 31 is a simplified diagrammatic representation of elements for controlling the apparatus of FIG. 30.

Referring also to FIG. 31, a diagrammatic representation of elements of a servo control scheme for apparatus 78 is shown. Essentially, honing parameters are inputted, for instance, utilizing a controller such as controller 46 of machine 30, as above, to effect operation of a servo drive which controls the servo valve to effect transfer of fluid to the cylinder for causing linear extension and retraction movements thereof. Feedback of the position is provided by a linear encoder which inputs positional data to the servo drive for use in controlling the servo valve. The apparatus of FIG. 30 and control scheme of FIG. 31 can be utilized for effecting stroking motions having cam profiles and velocity, acceleration and jerk profiles as illustrated and discussed above.

Figure 32:
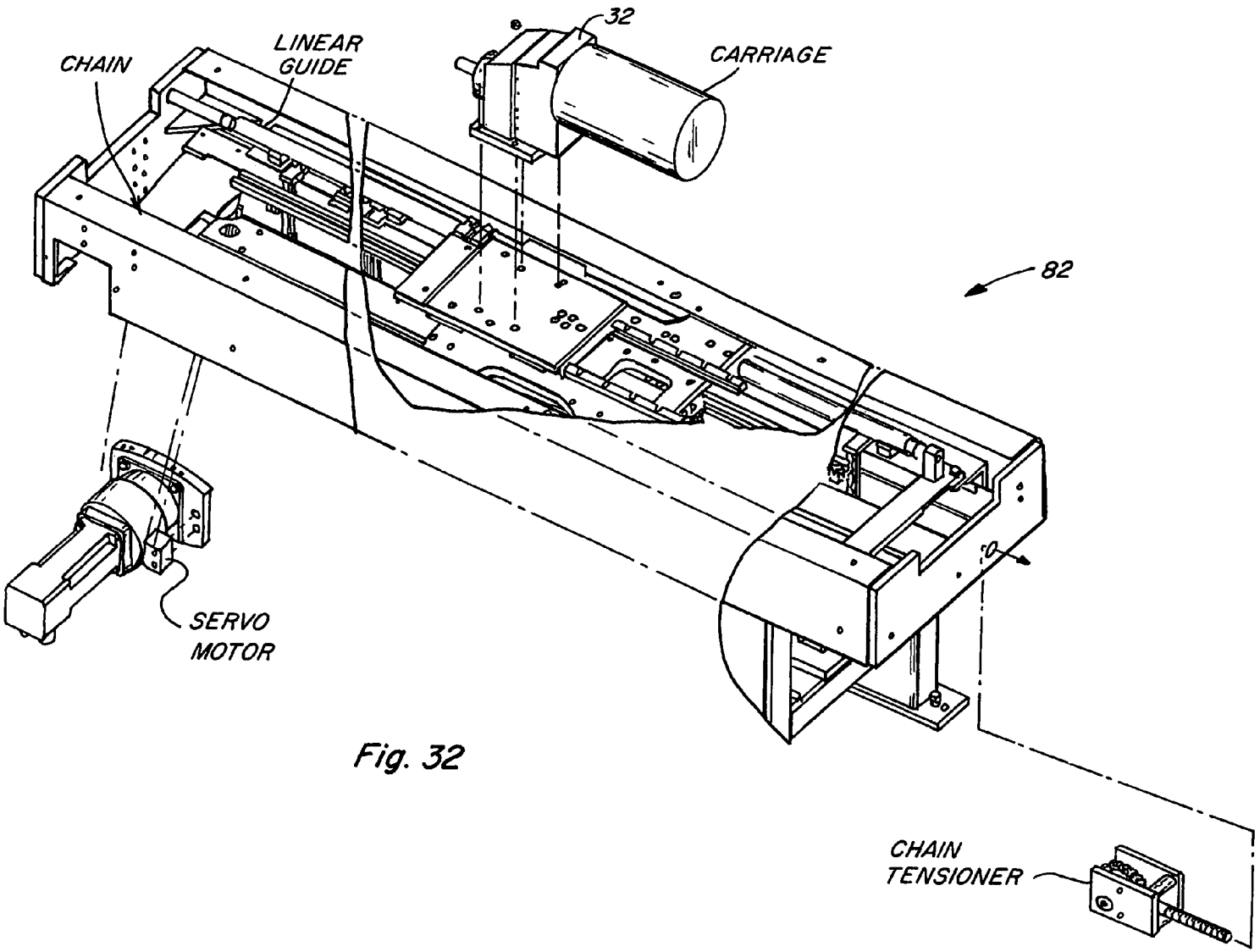
FIG. 32 is a simplified perspective representation of another alternative stroking apparatus for a honing machine according to the invention, the apparatus including a servo controlled chain drive.

Referring also to FIG. 32, another alternative stroking apparatus 82 for spindle carriage 32 of a honing machine, such as honing machine 30, is shown. Apparatus 82 is illustrative of a servo controlled chain drive in connection between a servo motor and carriage 32 for effecting linear movements of carriage 32 as guided by a linear guide.

Figure 33:
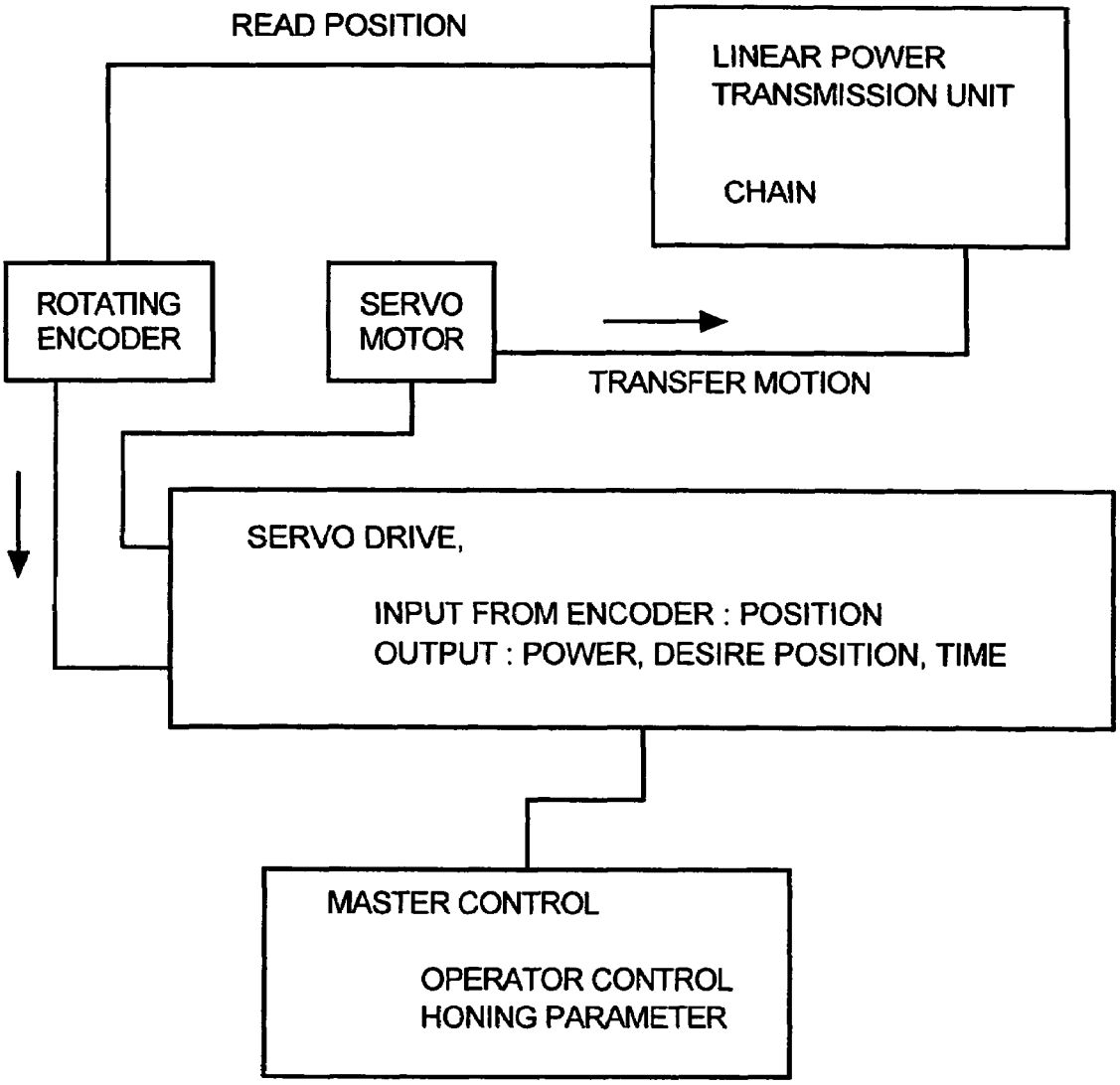
FIG. 33 is a simplified diagrammatic representation of elements of a control for the apparatus of FIG. 32.

FIG. 33 is a diagrammatic representation of elements of a control scheme for stroking apparatus 82, as controlled by a controller, such as controller 46 of honing machine 30. Essentially, a servo drive receives inputs from an encoder of the position of carriage 32 and outputs power and desired position and time parameters to the servo motor which transfers motion to the chain, thereby rotating the encoder which outputs the signals represented of the carriage position. Again, servo controlled stroking apparatus 82 can be operated to effect stroking actions of carriage 32 having any of the cam profiles discussed above.

Figure 34:
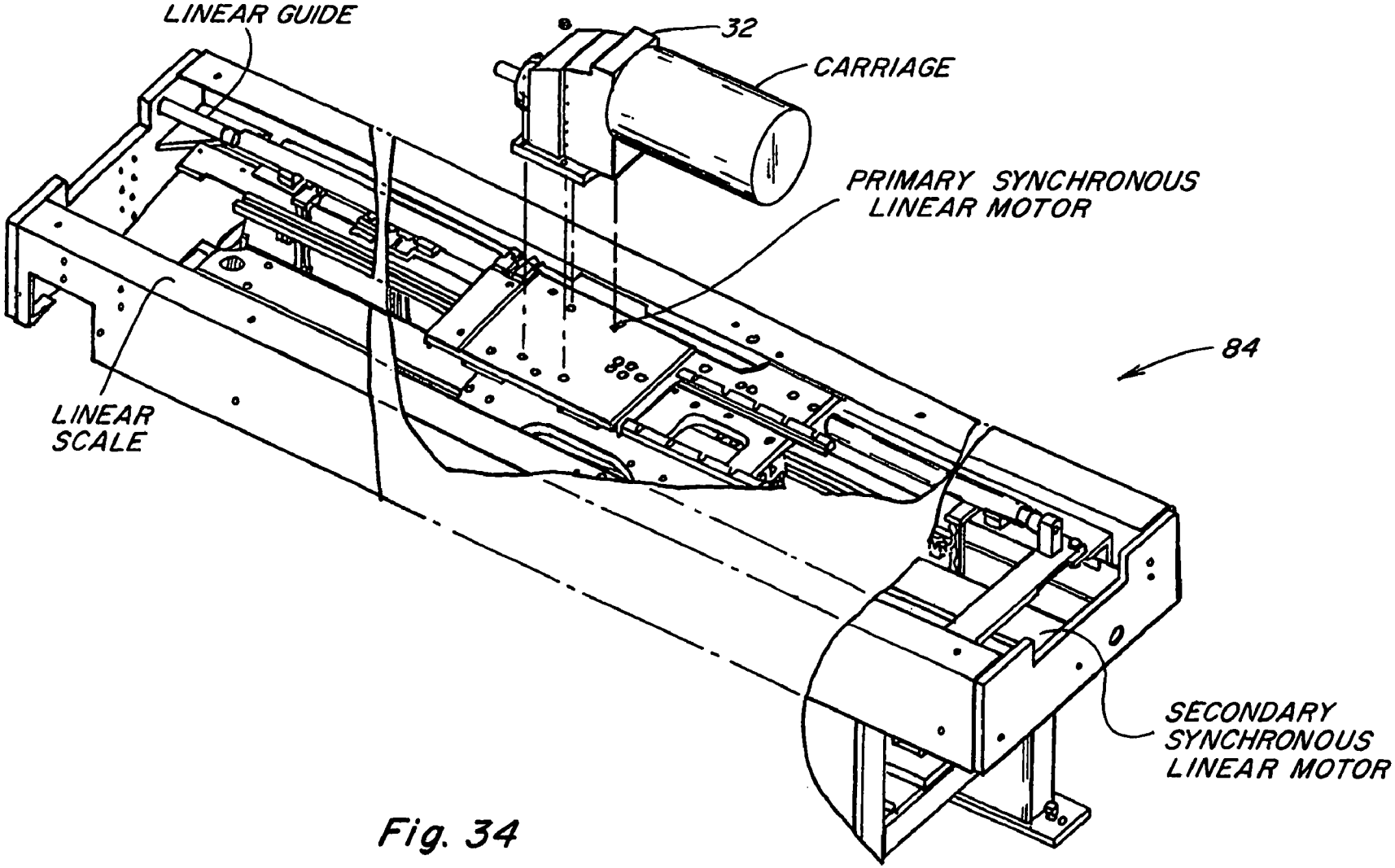
FIG. 34 is a simplified perspective representation of still another alternative stroking apparatus for a honing machine according to the invention, the apparatus including a servo controlled linear motor.

Referring also to FIG. 34, still another alternative servo controlled stroking apparatus 84 for spindle carriage 32 of a honing machine such as honing machine 30, is shown. Apparatus 84 includes a linear motion system including a synchronous linear motor in connection with carriage 32, for effecting controlled linear motion thereof.

Figure 35:
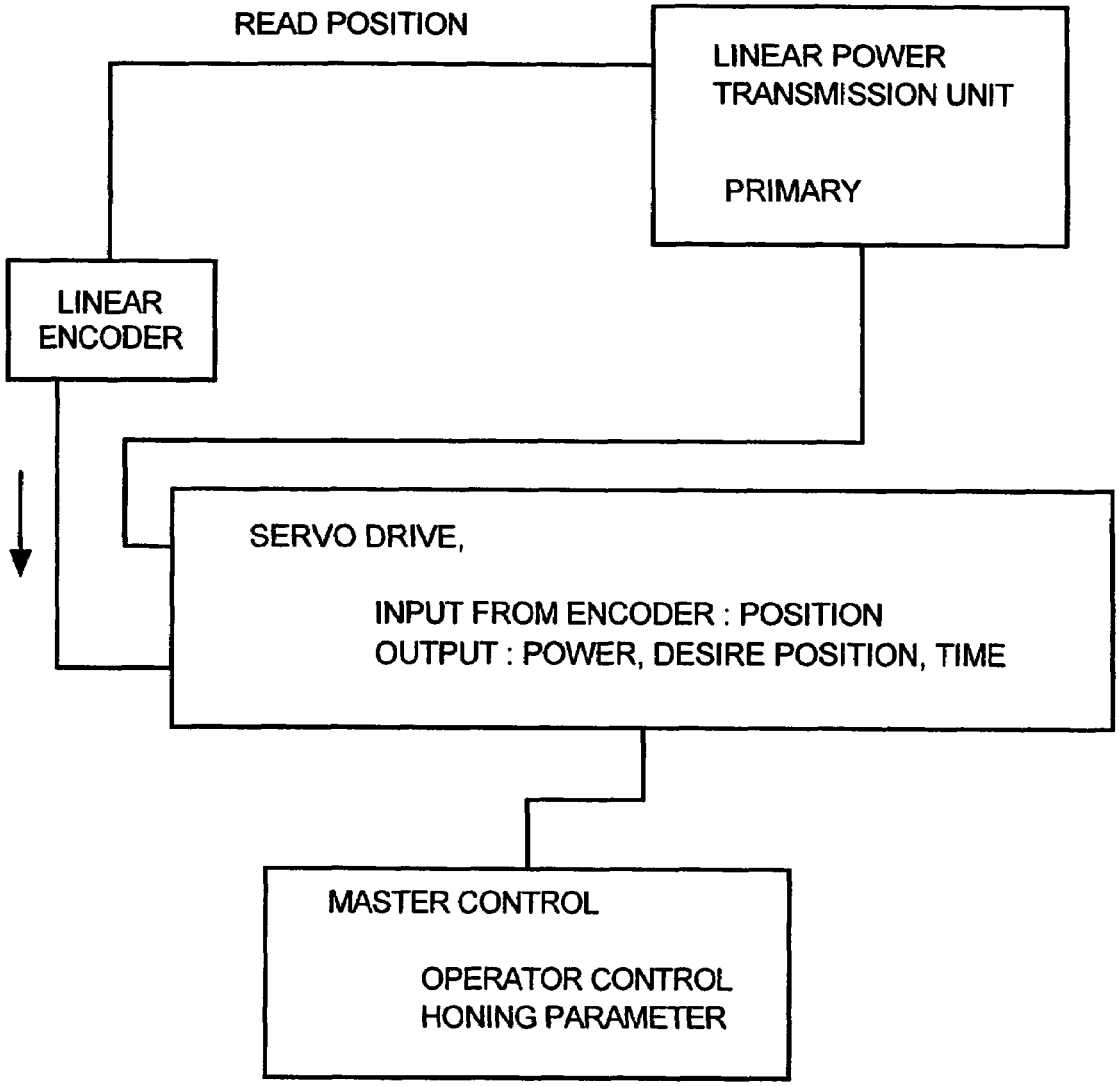
FIG. 35 is a simplified diagrammatic representation of elements for controlling the apparatus of FIG. 34.

FIG. 35 is a diagrammatic representation of elements of a control scheme for stroking apparatus 84, as controlled by a controller, such as controller 46 of honing machine 30. Again, essentially, a servo drive receives inputs from an encoder of the position of carriage 32 and outputs power and desired position and time parameters to the linear motor to effect changes in the carriage position. Again, servo controlled stroking apparatus 84 can be operated to effect stroking actions of carriage 32 having any of the cam profiles discussed above.

Thus, there has been shown and described a servo stroking apparatus and system, which overcomes many of the problems set forth above. It will be apparent, however, to those familiar in the art, that many changes, variations, modifications, and other uses and applications for the subject device are possible. All such changes, variations, modifications, and other uses and applications that do not depart from the spirit and scope of the invention are deemed to be covered by the invention which is limited only by the claims which follow.

What is claimed is:

1. A method of honing comprising steps of:

providing a honing machine including a honing element movable in a reciprocating stroking motion for honing a work piece;

providing a servo in connection with the honing element controllably operable for reciprocally stroking the honing element;

providing a servo drive in connection with the servo operable for controllably operating the servo; and operating the servo drive to control the servo for axially reciprocally stroking the honing element, such that during at least a portion of the reciprocal motion acceleration and deceleration of the honing element will have a combined profile selected from a group consisting of a cycloidal profile, a modified trapezoidal profile, a polynomial profile, and a modified sine profile, such that a resulting jerk profile of the portion of the reciprocal motion will be finite.

2. The method of claim 1, wherein the honing element comprises a honing tool.

3. The method of claim 1, wherein the servo comprises a ball screw mechanism.

4. The method of claim 1, wherein the servo comprises a linear motor.

5. The method of claim 1, wherein the servo comprises a fluid cylinder.

6. The method of claim 1, wherein the servo comprises a chain drive.

7. The method of claim 1, wherein the acceleration and deceleration of the honing element will have the profile selected from the group over substantially an entire length of the stroking motion thereof.

8. The method of claim 1, wherein the acceleration and deceleration of the honing element will have a profile selected from the group over only a portion of the length of the stroking motion thereof.

9. The method of claim 8, wherein the stroking motion includes at least one segment having a different acceleration and deceleration profile.

10. The method of claim 8, wherein the acceleration and deceleration of the honing element will have a profile which is a mix of at least two of the profiles of the group.

11. The method of claim 1, wherein as a result of the selected profile of the acceleration and deceleration of the honing element, the honing element will have a finite jerk profile over a length of the stroking motion for reducing vibrations of the machine.

12. The method of claim 1, wherein the polynomial profile is selected from a group consisting of a 345 polynomial and a 4567 polynomial.

13. The method of claim 1, wherein the honing element is rotatable about an axis of the reciprocating stroking motion during the stroking motion.

14. The method of claim 13, comprising an additional step of rotating the honing element during the reciprocating stroking motion thereof such that acceleration and deceleration of the rotation will have a combined profile selected from a group consisting of a simplified harmonic profile, a cycloidal profile, a modified trapezoidal profile, a polynomial profile, and a modified sine profile.

15. The method of claim 13, wherein the drive is operable for varying a speed of rotation of the honing element during the stroking motion for imparting a desired cross hatching pattern on a work piece being honed.

16. The method of claim 15, wherein the rotation of the honing element is controlled to have combined acceleration and deceleration profiles which are the same as the selected acceleration and deceleration profiles of the stroking motion.

17. The method of claim 1, wherein the honing element comprises an expandable honing tool and a drive operable for controllably expanding and retracting the honing tool.

18. The method of claim 1, wherein the stroking motion is a vertical motion, and the combined profile of the acceleration and the deceleration of an upward portion of the stroking motion of the honing element and the combined profile of the acceleration and the deceleration of a downward portion of the stroking motion are asymmetrical.

19. The method of claim 1, wherein the stroking motion is a horizontal motion.

20. The method of claim 1, wherein the profile of the acceleration and deceleration of the honing element is asymmetrical.

21. A honing machine comprising:

a honing element movable in a reciprocating stroking motion for honing a work piece;

a servo in connection with the honing element controllably operable for reciprocally moving the honing element in the stroking motion;

a servo drive in connection with the servo operable for controllably operating the servo; and a control in connection with the servo drive for operating the servo drive to control the servo for axially reciprocally stroking the honing element, such that during at least a portion of the reciprocal motion acceleration and deceleration of the honing element will have a profile selected from a group consisting of a cycloidal profile, a modified trapezoidal profile, a polynomial profile, and a modified sine profile, such that a resulting jerk profile of the reciprocal motion will be finite.

22. The machine of claim 21, wherein the honing element comprises a honing tool.

23. The machine of claim 21, wherein the servo comprises a ball screw mechanism.

24. The machine of claim 21, wherein the servo comprises a linear motor.

25. The machine of claim 21, wherein the servo comprises a fluid cylinder.

26. The machine of claim 21, wherein the servo comprises a chain drive.

27. The machine of claim 21, wherein the acceleration and deceleration of the honing element will have the profile selected from the group over substantially an entire length of the stroking motion thereof.

28. The machine of claim 21, wherein the acceleration and deceleration of the honing element will have the profile selected from the group over only a portion of a length of the stroking motion thereof, and will have at least one other profile over a remaining portion of the length of the stroking motion.

29. The machine of claim 21, wherein the profile of the acceleration and deceleration of the honing element is selected such that the honing element will have the finite jerk profile over substantially all of the stroking motion.

30. The machine of claim 21, wherein the polynomial profile is selected from a group consisting of a 345 polynomial and a 4567 polynomial.

31. The machine of claim 21, further comprising a drive controllably operable for rotating the honing element during the reciprocating stroking motion thereof.

32. The machine of claim 31, wherein the drive is operable for varying a speed of rotation of the honing element during the stroking motion for imparting a desired cross hatching pattern on a work piece being honed.

33. The machine of claim 32, wherein the rotation of the honing element is controlled to have combined acceleration and deceleration profiles which are the same as the selected acceleration and deceleration profiles of the stroking motion.

34. A method of honing comprising steps of:

providing a honing machine including structure supporting a honing tool so as to be movable in a reciprocating linear motion while the honing tool is rotated, for honing a work piece;

providing a servo in connection with the honing element controllably operable for reciprocally moving the honing element; and controllably operating the servo for linearly reciprocally stroking the honing element, such that during at least a portion of the reciprocal motion acceleration of the honing element will have a profile comprising a mixture of at least two of a simplified harmonic profile a cycloidal profile, a modified trapezoidal profile, a polynomial profile, and a modified sine profile, such that a resulting jerk profile of the reciprocal motion will be finite.

35. The method of claim 34, wherein the acceleration of the honing tool will have the profile over substantially an entire length of the stroking motion thereof.

36. The method of claim 34, wherein the acceleration of the honing tool will have the profile only over a portion of a length of the stroking motion thereof.

37. The method of claim 35, wherein a speed of rotation of the honing tool during the stroking motion is varied during the stroking motion for imparting a desired cross hatching pattern on a work piece being honed.

38. The method of claim 37, wherein the rotation of the honing tool is controlled to have an acceleration profile which is about the same as the acceleration profile of the stroking motion.

* * * * *